US011066878B1

(12) United States Patent
Wilson et al.

(10) Patent No.: US 11,066,878 B1
(45) Date of Patent: Jul. 20, 2021

(54) DOWNHOLE TUBULAR DISCONNECT ASSEMBLIES

(71) Applicants: Paul James Wilson, Cypress, TX (US); Robert Bradley Cook, Mandeville, LA (US); Daniel Teen, Mandeville, LA (US); Glenn Mitchel Walls, Madisonville, LA (US)

(72) Inventors: Paul James Wilson, Cypress, TX (US); Robert Bradley Cook, Mandeville, LA (US); Daniel Teen, Mandeville, LA (US); Glenn Mitchel Walls, Madisonville, LA (US)

( * ) Notice: Subject to any disclaimer, the term of this patent is extended or adjusted under 35 U.S.C. 154(b) by 0 days.

(21) Appl. No.: 16/942,739

(22) Filed: Jul. 29, 2020

Related U.S. Application Data

(63) Continuation of application No. 16/004,036, filed on Jun. 8, 2018, now abandoned.

(60) Provisional application No. 60/516,670, filed on Jun. 8, 2017.

(51) Int. Cl.
*E21B 17/06* (2006.01)
*E21B 19/16* (2006.01)
*E21B 23/00* (2006.01)

(52) U.S. Cl.
CPC ..... *E21B 17/06* (2013.01); *E21B 19/16* (2013.01); *E21B 23/00* (2013.01)

(58) Field of Classification Search
CPC ..... E21B 17/06; E21B 19/16; E21B 23/00
See application file for complete search history.

(56) References Cited

U.S. PATENT DOCUMENTS 4,452,472 A * 6/1984 Crase ..... E21B 4/02 285/18
5,086,844 A * 2/1992 Mims ..... F16L 37/62 166/383
6,131,953 A * 10/2000 Connell ..... E21B 17/06 285/3
7,174,963 B2 * 2/2007 Bertelsen ..... E21B 17/06 166/242.7
7,958,941 B2 * 6/2011 Hueston ..... E21B 33/04 166/382

* cited by examiner

*Primary Examiner* — Taras P Bemko
*Assistant Examiner* — Jonathan Malikasim
(74) *Attorney, Agent, or Firm* — Elliott Law PLLC; Douglas H. Elliott; Nathan Q. Huynh

(57) ABSTRACT

Disclosed herein are downhole disconnect assemblies for disconnecting downhole tubulars. Those disconnect assemblies may each include: 1) a housing having an inner surface and a groove disposed in the inner surface; 2) a sub disposed in the housing, the sub having a window aligned with the groove; 3) a locking lug extending through the window and having a projection removably disposed in the groove; 4) a prop sleeve disposed in the sub and releasably coupled to the locking lug; and 5) a load transfer sleeve pushing the housing.

17 Claims, 10 Drawing Sheets

FIG. 4D
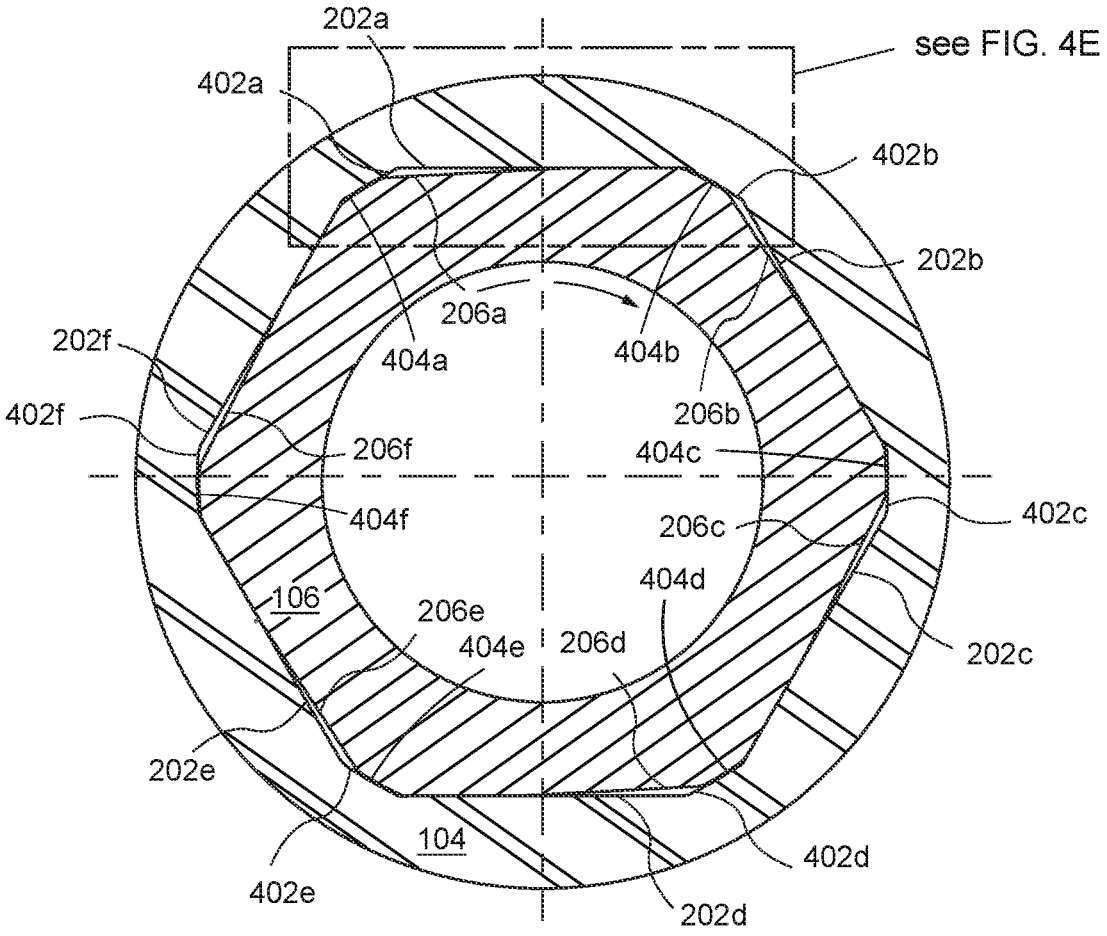
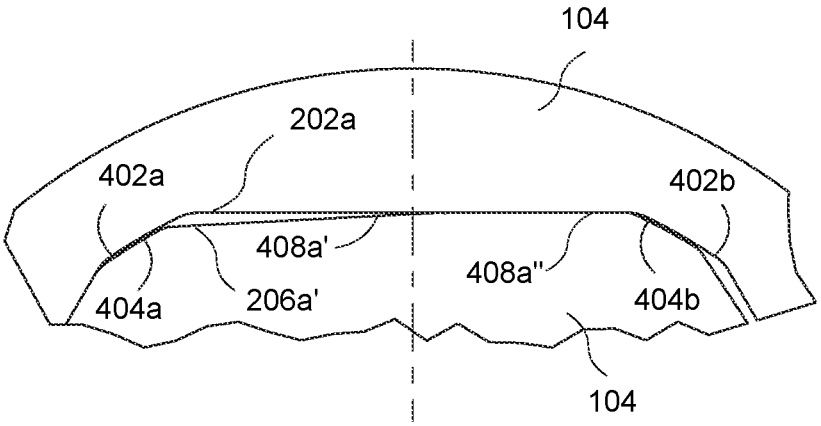
FIG. 4E

DOWNHOLE TUBULAR DISCONNECT ASSEMBLIES

RELATED APPLICATIONS

This application is a continuation-in-part of and claims benefit to co-pending non-provisional application Ser. No. 16/004,036, filed on Jun. 8, 2018, which claims benefit to provisional application Ser. No. 60/516,670, filed on Jun. 8, 2017; and this application hereby incorporates herein those applications and all amendments thereto as if set forth herein in their entireties.

BACKGROUND

Field of Inventions

The field of this application and any resulting patent is downhole tubular disconnect assemblies.

Description of Related Art

Deep well drilling for gas, crude petroleum, minerals, and even water or steam requires tubes of massive size and wall thickness. Tubular drill strings may be suspended into a borehole that penetrates the earth's crust several miles beneath the drilling platform from the earth's surface. Situations may arise while drilling where the drill string becomes "stuck" deep in the wellbore. Stuck drill strings may result from wellbore cave-in, sloughing, differential pressure sticking, formation swelling, or failure to sufficiently circulate cuttings. To loosen a stuck drill string, an operator must discontinue drilling and attempt to pull, push, and/or twist the drill string. The operator may also run additional tools in the drill string, such as drilling jars, to augment the loosening process. Such time-consuming operations may cause drilling to overrun budgeted costs.

After unsuccessful attempts to loosen the drill string, the operator may decide to disconnect the drill string and abandon the stuck portion or "fish" it out afterwards. To disconnect the drill string, the operator first estimates the depth of the "stuck point". Then, the operator attempts to disconnect the pipe as close to the stuck point as possible to retrieve the portion of the drill string above the stuck point.

A hydraulically actuated drill pipe disconnect may be deployed as an integral part of the drill string at predetermined locations (based on prior drilling history and/or placed in the drill string strategically to retrieve expensive hardware like MWD logging instruments). Such a disconnect may be operated, on-command, by pumping an actuating device down the drill pipe to engage the disconnect and initiate or actuate the release. Similarly, the actuating device may be deployed on wireline.

Drilling operations apply severe stress cycles on the bottom hole assembly in a very short time. The drill pipe may rotate from 20 to 1000 rpm, thus applying torque to the drill pipe. The stress cycles required to induce failure in a tool can be as short as a few hours. One of the most failure-prone components in a drill string is the downhole disconnect assembly, which has multiple points of failure.

One point of failure relates to windows disposed in the body of subs in the disconnect. Many downhole tubular disconnect assemblies use a set of rectangular lugs that rest on an internal shoulder in the bottom sub of the disconnect as a means of supporting tensile load. The lugs are disposed in rectangular-shaped windows which are usually machined radially into the side of the lower sub of the disconnect, or upper sub, depending on design. The shape of these windows tends to represent a problem because of the stress risers of the corner of the windows.

A second point of failure with many downhole tubular disconnect assemblies is the location of the windows. When the drill string is rotated, the downhole disconnect assembly transmits torque to the lower drill pipe so that the drill bit will rotate. Torque is transmitted through the downhole disconnect assembly at a torque transmission area. The windows, in which the lugs in the downhole disconnect assembly are disposed, are frequently located within the torque transmission area. Thus, torque is applied at or through the windows, which increases the possibility of failure.

During drilling, the lower drill pipe torques up so that the drill bit will start to cut. When the drill cuts, the torque is momentarily released. Since the cutting operation is not uniform, cycles of cutting and releasing result in corresponding cycles of torque application followed by torque release. The chance of failure increases as the number of cycles increases.

Often, when drilling a horizontal well, the trajectory of the wellbore requires a significant bend from vertical to horizontal. When the drill string passes through a severe bend or dogleg, the drill pipe has enough flexibility to permit the middle of the disconnect to contact one side of the wellbore, while the top and bottom of the disconnect contact the opposite side of the wellbore. Thus, a bending moment is applied to the downhole disconnect assembly. This cyclic bending moment varies with the rotational speed and applied torque.

The bending stresses are accentuated by the rigidity of the typical downhole disconnect assembly, which are usually constructed with outside diameters larger than the drill pipe, akin to drill collars and thread jointed in close succession.

The torqueing and bending results in stress cycling across the window which can result in a fatigue cracking problem. The present invention mitigates this problem by locating the windows outside the torque transmission area.

A third point of failure with existing downhole tubular disconnect assemblies relates to the method of transmitting torque in the tool. Some disconnects, such as that described in U.S. Pat. No. 5,146,984, use interconnected splines which are machined in the top and bottom subs. Other disconnects use machined fingers that fit into matching notches. Generally, these and other similar disconnects present problems with fretting or fatigue cracking due to the reverse stress cycling loads that is inherent to drill string assemblies.

A fourth point of failure with existing downhole tubular disconnect assemblies relates to excessive "play" between lugs, windows and the upper housing portion, which can lead to premature fretting and fatigue of the load bearing components.

A fifth point of failure with downhole tubular disconnect assemblies relates to stretching of the joint in the tool. High tensile loads, typical to drill string applications, can stretch pipe threaded joints. Effective design of drill pipe joints, called rotary shouldered connections (RSC), requires thread makeup sufficient to shoulder the box/pin joint and pre-load the joint. This pre-load provides that there is no shoulder separation under the prescribed tensile and bending moments. Shoulder separation of the joint under load leads to joint failure.

For the foregoing reasons, there is a need for a downhole disconnect assembly that reduces applied stresses between components to mitigate failure of the components and improve tool life.

Various downhole tubular disconnect assemblies and methods for disconnecting downhole tubular have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

Disclosed herein are downhole disconnect assemblies for disconnecting downhole tubulars, which disconnect assemblies may include: 1) a housing having: a) a first inner surface and a first outer surface; b) an upper socket and a lower socket on the first inner surface; and c) a plurality of radial grooves formed on the first inner surface between the sockets; 2) a window sub having: a) a second inner surface and a second outer surface; b) an upper torque transfer profile and a lower torque transfer profile disposed about the second outer surface for respective slidable mating with the upper and lower sockets on the housing, thereby preventing relative rotation between the window sub and housing; and c) a window defined between the torque transfer profiles therein; 3) a locking lug disposed in the window sub for locking the window sub to the housing and the sockets, thereby preventing relative longitudinal movement between the window sub and housing; 4) a prop sleeve for disengaging the locking lug, thereby allowing for longitudinal movement of the housing relative to the window sub; and 5) a load transfer sleeve for transferring a tensile pre-load to the housing and window sub.

Additionally, disclosed herein are downhole disconnect assemblies for disconnecting downhole tubulars downhole, which disconnect assemblies may include: 1) a housing having an inner surface and a groove disposed in the inner surface; 2) a sub disposed in the housing, the sub having a window aligned with the groove; 3) a locking lug extending through the window and having a projection removably disposed in the groove; 4) a prop sleeve disposed in the sub and releasably coupled to the locking lug; and 5) a load transfer sleeve pushing the housing.

Also, disclosed herein are downhole disconnect assemblies for disconnecting downhole tubulars downhole, which disconnect assemblies may include: 1) a housing comprising: a) a first set of socket surfaces; b) a second set of socket surfaces; and c) a groove disposed between the first set of socket surfaces and the second set of socket surfaces of the housing; 2) a sub disposed in the housing, the sub comprising: a) a first set of socket surfaces; b) a second set of socket surfaces; and c) a window disposed between the first set of socket surfaces and the second set of socket surfaces of the sub; and 3) a locking lug extended through the window into the groove.

Furthermore, disclosed herein are downhole disconnect assemblies for disconnecting downhole tubulars downhole, which disconnect assemblies may include: 1) deploying a dart down the downhole tubular string; 2) coupling the dart to a prop sleeve of a tubular disconnect assembly disposed on the downhole tubular string; 3) pumping a first volume of fluid into the downhole tubular string; 4) displacing the prop sleeve axially; and 5) forcing, with a housing of the tubular disconnect assembly, a locking lug away from the housing.

BRIEF DESCRIPTION OF THE DRAWINGS

FIG. 4D illustrates an alternative version of a window sub disposed concentrically in a disconnect housing, taken on the line A-A and/or B-B of FIG. 1 looking in the direction of the arrows.

FIG. 4E illustrates a magnified view of a portion of a window sub disposed in a disconnect housing, wherein the windows sub has a window socket surface having a plurality of surface portions.

DETAILED DESCRIPTION

1. Introduction

Figure 1A:
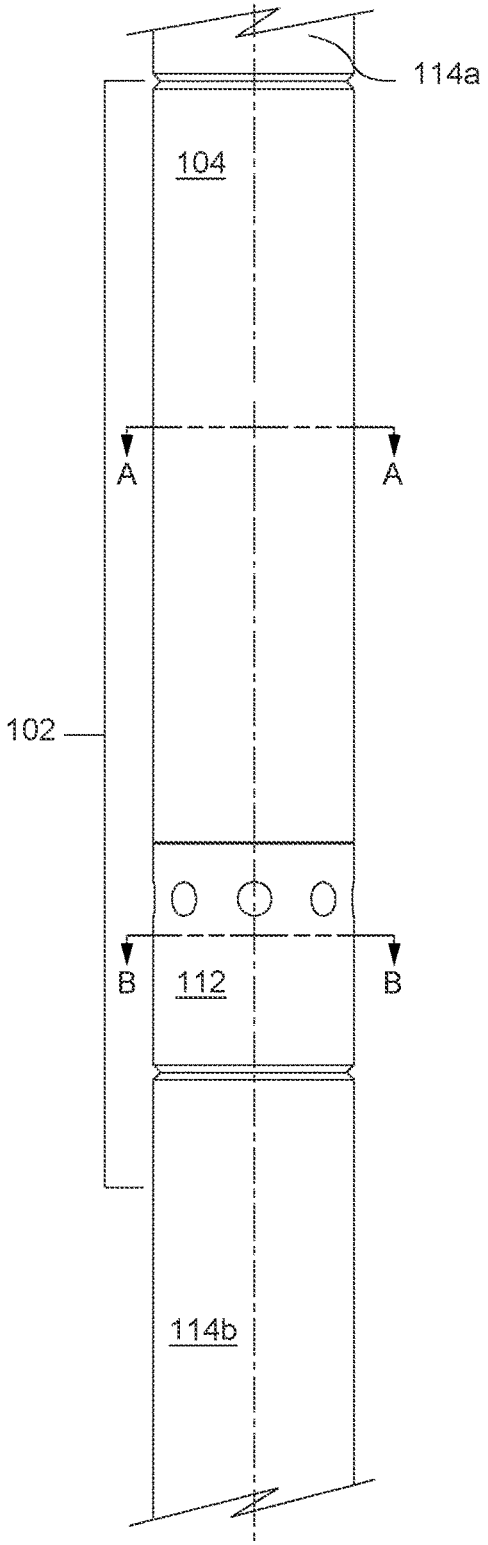
FIG. 1A illustrates a profile view of a portion of a downhole tubular string including a tubular disconnect assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "abutted against" as used herein is defined as being positioned adjacent to and either physically touching or pressing against, directly or indirectly. For example, a first object may be abutted against a second object such that the second object is limited from moving in a direction of the first object.

The term "adjacent" as used herein means next to and includes physical contact but does not require physical contact.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., disconnect housing, a window sub, a prop sleeve, a load transfer sleeve, a housing, a sleeve, or a tubular. For example, an aperture may be an opening that begins on one side of a solid object and ends on the other side of the object. An aperture may alternatively be an opening that does not pass entirely through an object, but only partially passes through, e.g., as a groove. One or more grooves may be formed on an outer surface of an object to form pin grooves. One or more grooves may be formed on the inner surface of an object, e.g., disconnect housing, to form box grooves. An aperture can be an opening in an object that is completely circumscribed, defined, or delimited by the object itself. Alternatively, an aperture can be an opening formed when one object is combined with one or more other objects or structures. An aperture may receive an object, e.g., a window sub, a prop sleeve, a load transfer sleeve, a housing, a sleeve, and/or a tubular. For example, a window sub may be received in an aperture of a disconnect housing.

The term "assembly" as used herein is defined as any set of components that have been fully or partially assembled together. A group of assemblies may be coupled to form a solid housing having an inner surface and an outer surface.

The term "boss" as used herein is defined as a cylindrical protuberance on a work piece, e.g., a tubular or a shaft. An object may be coupled to a boss of another object. A boss may have a riser face and a tread face, or outer perimeter, that intersects each other to form an angle. For example, a prop sleeve may be slid on the tread of a boss of a locking lug.

The term "connecting surface" as used herein is defined as a surface that is coupled to two or more other surfaces. A connecting surface may be radiused. Accordingly, each connecting surface may also define an arc. A connecting surface may be planar.

The term "coupled" as used herein is defined as directly or indirectly connected or attached. A first object may be coupled to a second object such that the first object is positioned at a specific location and orientation with respect to the second object. For example, a tubular may be coupled to a disconnect housing. A first object may be either permanently, removably, slidably, releasably, shearably, threadably, pivotably, and/or anti-rotatably coupled to a second object. Two objects may be "removably coupled" to each other via shear pins, threads, tape, latches, hooks, fasteners, locks, male and female connectors, clips, clamps, knots, and/or surface-to-surface contact. For example, a locking lug and disconnect housing may be removably coupled to each other such that the locking lug may then be uncoupled and removed from a disconnect housing. Two objects may be "slidably coupled" together, where an inner aperture of one object is capable of receiving a second object. For example, a locking lug slid through a window of a window sub may be slidably coupled to the window. Two objects may be "releasably coupled" together, wherein a first object coupled to a second is capable of movement after a second object is moved, e.g., slid, rotated, or removed. For example, a locking lug and a prop sleeve may be releasably coupled, wherein the locking lug coupled to a prop sleeve can be moved after the prop sleeve is slid relative to the locking lug. Two objects may be "shearably coupled" together, e.g., where a pin is extended through the objects and force applied to one object may break or shear the pin. For example, a pin may be extended through a prop sleeve and a window sub, and force applied to the prop sleeve may be transferred to the pin to cause the pin to be sheared or broken. Additionally, two objects may be capable of being "threadably coupled," e.g., where a threaded outer surface of one object is capable of being engaged with or to a threaded inner surface of another object. Threadably coupled objects may be removably coupled. Accordingly, a window sub may be threadably coupled to a tubular where a threaded inner surface, e.g., box threads or female threads, of the tubular may be engaged with a threaded outer surface, e.g., pin threads or male threads, of the window sub. Two objects may be "anti-rotatably coupled" together, e.g., where the first object may be inhibited from being rotated relative to the second object. For example, a window sub may be anti-rotatably coupled to a disconnect housing where the disconnect housing, in some cases, may not be rotated relative to the window sub. Anti-rotatably coupled objects may still be moved axially relative to each other.

The term "cylindrical" as used herein is defined as shaped like a cylinder, e.g., having straight parallel sides and a circular or oval or elliptical cross-section. Examples of a cylindrical structure or object may include a disconnect housing, a window sub, a prop sleeve, a load transfer sleeve, a pin, a housing, a sleeve, and a tubular. A cylindrical object may be completely or partially shaped like a cylinder. For example, a disconnect housing may have an aperture that is extended through the entire length of a disconnect housing to form a hollow cylinder capable of permitting another object, e.g., a window sub, a prop sleeve, a load transfer sleeve, a dart, a housing, a sleeve, and/or a tubular, to be extended or passed through. Alternatively, a solid cylindrical object may have an inner surface or outer surface having a diameter that changes abruptly. A cylindrical object may have and inner or outer surface having a diameter that changes abruptly to form a "lip," e.g., face, collar, or rim. A cylindrical object may have a collar extending toward or away from the central axis line of the object. A cylindrical object may have a collar on an inner surface. A cylindrical object may have a collar on an outer surface. Additionally, a cylindrical object, may have a collar that is tapered or radiused.

The term "dart" as used herein is defined as a structure configured to land on another structure, e.g., seat, prop sleeve, or bypass sleeve. Examples of a dart may include a ball, a plug, and a wedge. A dart may have a tapered profile. A dart may be elongated. A dart may inhibit fluid flow.

The terms "first" and "second" as used herein merely differentiate two or more things or actions, and do not signify anything else, including order of importance, sequence, etc.

The term "flow path" as used herein is defined as a conduit or space through which fluid is capable of flowing. A flow path may be disposed within an object, e.g., a disconnect housing, a window sub, a prop sleeve, a load transfer sleeve, a housing, a sleeve, and/or a tubular. A flow path may extend uninterrupted through ends of an object, e.g., a disconnect housing, a window sub, a prop sleeve, a load transfer sleeve, a housing, a sleeve, and/or a tubular. A flow path may be formed by a groove disposed on an object. A flow path may be a groove disposed in an outer surface of an object. A flow path may be formed by the inner surface of an object. A flow path may be formed by the inner surface of a group of coupled objects, e.g., a disconnect housing, a window sub, a prop sleeve, a load transfer sleeve, a housing, a sleeve, and/or a tubular. A flow path may be formed from two or more connected flow paths.

The term "flow rate" as used herein is defined as the volume of material that passes per unit of time. Volume may be measured in, e.g., gallons or liters. Time may be measured in, e.g., seconds, minutes, or hours. A flow rate of a pumped fluid may be measured at the surface. A flow rate of a pumped fluid may be measured before the fluid is pumped into a downhole tubular string. A flow rate of a pumped fluid may be measured at a station or a pump that pumped the fluid. A "pump down fluid flow rate" may range from as low as 30, 35, 40, 45, 50, 55 gallons per minute to as high as 60, 70, 80, 90, 120, 160 gallons per minute or higher. An "actuation fluid flow rate" may range from as low as 55, 60, 65 gallons per minute to as high as 120, 140, 160, 200, 250 gallons per minute or higher.

The term "fluid" as used herein is defined as material that is capable of flowing. A fluid may be, e.g., a liquid or a gas. Examples of a fluid may include hydrocarbon, water, drilling fluid, drilling mud, cement, lubricant, cleaning fluid, and motor oil. A fluid can be a mixture of two or more fluids. A fluid may absorb heat. A fluid may have properties such as viscosity, anti-foaming, thermal stability, thermal conductivity, and thermal capacity. Fluid in a downhole tubular string used in driving a motor, e.g., motor, may be call "mud." A fluid may be water-based, oil-based, synthetic, or a combination of viscous materials and solid materials.

The term "fluid port" as used herein is defined as an aperture in a structure for providing ingress and/or egress of fluid therethrough. A fluid port may be disposed in a disconnect housing, a window sub, a prop sleeve, a load transfer sleeve, a housing, a sleeve, and/or a tubular. A fluid port may be disposed in a tubular, e.g., housing or sleeve of a tubular disconnect assembly or circulating valve assembly. A fluid port may extend through a shaft assembly. A fluid port may extend in a direction perpendicular to the central axis of a tubular. Fluid ports may be disposed symmetrically around a tubular. In some cases, fluid ports may not necessarily be precisely the same circumferential distance apart. The preferable circumferential distance between each fluid port in a tubular may be approximately 360 degrees divided by the number of fluid ports.

The term "housing" as used herein is defined as a structure, preferably a cylindrical structure, configured to receive therein fluid and/or one or more objects. Types of housings may include a disconnect housing, a window sub, a prop sleeve, a load transfer sleeve, a housing, a sleeve, and/or a tubular. A housing may be configured to be filled with fluid, e.g., hydrocarbon, water, drilling fluid, cement, lubricant, and/or cleaning fluid. A housing may have a central aperture extending therethrough. A housing may have one or more threaded ends for coupling with another housing. Multiple housings may be coupled axially to form a longer housing. A housing may receive another object or structure therein. A housing and an object or structured disposed therein may be concentric.

The term "locking lug" as used herein is defined as a structure capable of coupling two or more objects together. For example, a locking lug may be used to couple a window sub and/or a prop sleeve. A locking lug may include two or more surface portions. A locking lug may include two or more surface portions that defines one or more grooves. A locking lug may inhibit axial movement of a disconnect housing relative to a window sub. A locking lug may be disposed in window of a window sub. A locking lug may have a surface abutted against an object, e.g., prop sleeve. A locking lug may have teeth or projections. A locking lug may have teeth capable of being coupled to teeth or threads disposed on disconnect housing. A locking lug may have a portion abutted against threads disposed on disconnect housing. A locking lug may have a portion abutted against a radiused surface of a window sub. A locking lug may have a portion abutted against a surface of a prop sleeve.

The term "obround" as used herein is defined as having a shape consisting of two semicircles connected by parallel lines tangent to their endpoints.

The term "pressure" as used herein is defined as force per unit area. Pressure may be exerted against a surface of an object, e.g., piston head, sleeve, seat, and/or dart, from the flow of fluid across the surface.

The term "providing" as used herein is defined as making available, furnishing, supplying, equipping, or causing to be placed in position.

The term "pin" as used herein is defined as a structure capable of being received in an aperture or groove of another structure, e.g., for coupling two objects or inhibiting movement of an object. A pin may also be referred to as a lug. A pin may have a tapered end. A pin may be broken via dissolving or breaking, e.g., shearing or snapping. A pin may be broken upon application of threshold force against the pin. A pin may be used to shearably couple a prop sleeve to a window sub.

The terms "pipe", "tube", "tubular" "casing", "liner" are tubular goods having an inner surface and an outer surface and an inner diameter and an outer diameter.

The term "projection" as used herein is defined as a structure and/or protrusion extending from an object or structure. A projection may be received in an aperture, e.g., groove. For example, a locking lug may have one or more projections removably disposed in one or more grooves disposed on a disconnect housing.

The term "pushing" as used herein is a verb that means applying force e.g., towards and/or against an object or structure, directly or indirectly. Pushing may compel, e.g., urge, cause, influence, force, and/or press, displacement of an object; however, the object may or may not be displaced. A first object pushing a second object may transfer force to the second object. A first object pushing a second object may cause the second object to push a third object, directly or indirectly. For example, a cap or a tubular pushing a load transfer sleeve may cause the load transfer sleeve to push, directly or indirectly, a housing and/or a window sub. A first object directly pushing a second object may physically touch the second object. A first object indirectly pushing a second object may physically touch a medium that physically touches the second object; the medium may be a structure, e.g., washer, spacer, or seal.

The term "radiused" as used herein is defined as having a contour that is curved, semicircle, and/or hemispherical. Radiused surfaces may be concave or convex.

The term "seat" as used herein is defined as a structure for receiving an object, e.g., a dart, thereon. A seat may receive a dart. A seat may have an inner surface that defines an aperture disposed therethrough. A seat may have one or more socket surfaces disposed in an inner surface of the seat. A prop sleeve may have a landing seat. Multiple seats may be coupled a downhole tubular or tubular string. Each seat disposed above a lower seat on a downhole tubular or tubular string may an inner surface having a diameter larger than that of the lower seat.

The term "sleeve" as used herein is defined as a tubular. Types of sleeves may include a prop sleeve and a load transfer sleeve. The term "prop sleeve" as used herein is defined as a sleeve capable of being slidably coupled to a locking lug. A prop sleeve may have surface portions that can be received in grooves of a locking lug. The term "load transfer sleeve" as used herein is defined as a sleeve capable of directly or indirectly transferring force to a disconnect housing. A load transfer sleeve may have a first portion, e.g., upper face, abutted against a disconnect housing and a second portion, e.g., a lower shoulder, abutted against a window sub.

The term "slickline" as used herein is defined as a non-conductive cable extendable from surface to a downhole tool.

The term "socket surfaces" as used herein is defined as connected surfaces having a polygonal cross-section. An example of a polygonal cross-section may be triangular, square, rectangular, pentagonal, hexagonal, or octagonal. Socket surfaces may have surfaces connected to form a polygonal shape, e.g., triangular, square, rectangular, pentagonal, hexagonal, or octagonal. Males socket surfaces may be on an outer surface of a cylindrical structure, e.g., window sub, sleeve, housing, rod, and/or bolt. Female socket surfaces may be on an inner surface of a cylindrical structure, e.g., disconnect housing, nut, and/or tubular. Female socket surfaces of a disconnect housing are capable of being aligned with male socket surfaces of a window sub. Female socket surfaces of a disconnect housing are capable of being abutted against male socket surfaces of a window sub. A window sub or a disconnect housing may have three, four, five, seven, eight, or more socket surfaces. A window sub or a disconnect housing may have three, four, five, seven, eight, or more connecting surfaces. A window sub may have the same number sockets surfaces as that of the number of housing socket surfaces of a corresponding disconnect housing.

The term "sub" as used herein is defined as a tubular capable of being disposed in a housing, a sleeve, or another tubular. A type of a sub may include a window sub.

The term "surface" as used herein is defined as any face of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a landing seat, a disconnect housing, a window sub, a prop sleeve, a load transfer sleeve, a housing, a sleeve, and/or a tubular. A surface may have irregular contours. A surface may be formed from coupled components, e.g., a disconnect housing, a window sub, a prop sleeve, a load transfer sleeve, a housing, a sleeve, and/or a tubular. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal. Socket surfaces may have curved walls connected to form a substantially polygonal shape, e.g., triangular, square, rectangular, pentagonal, hexagonal, or octagonal.

The term "tapered" as used herein is defined as becoming progressively smaller at one end. Structures that are tapered may have a profile that is beveled, frustoconical, and/or conical.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a disconnect housing, a window sub, a prop sleeve, a load transfer sleeve, a housing, a sleeve, and a tubular. Threads formed on an inner surface of an object may be referred to as "box threads." Threads formed on an outer surface of an object may be referred to as "pin threads." A threaded assembly may include a "threaded portion" wherein a section of the threaded assembly includes threads, e.g., pin threads or box threads. A threaded portion may have a diameter sized to extend through an aperture of a sleeve, a housing, or a collar. In certain cases, a threaded portion of a first object may be removably coupled to a threaded portion of a second object.

The term "tubular" as used herein is defined as a structure having an inner surface and an outer surface. A tubular may have an aperture disposed therethrough. Preferably, a tubular is cylindrical. Examples of a tubular may a disconnect housing, a window sub, a prop sleeve, a load transfer sleeve, a housing, a sleeve, and a tubular. However, any or all tubulars of an assembly may have polygonal cross-sections, e.g., triangular, rectangular, pentagonal, hexagonal, or octagonal.

The term "tubular disconnect assembly" as used herein is defined as an assembly capable of deployment within a tubular string, e.g., to uncouple portions of the tubular string. A tubular disconnect assembly may be coupled with a landing seat to form a tubular disconnect assembly. A tubular disconnect assembly may include a disconnect housing, a window sub, a prop sleeve, a load transfer sleeve, a housing, a sleeve, and/or a tubular.

The term "unitary" as used herein defined as having the nature, properties, or characteristics of a single unit. For example, socket surfaces that are individual parts of a disconnect housing or a window sub may be unitary in the sense they are not separate but rather are formed from a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a disconnect housing, a window sub, a prop sleeve, a load transfer sleeve, a housing, a sleeve, and/or a tubular may each have an upper end and a lower end. Additionally, a cylindrical object, e.g., a disconnect housing, a window sub, a prop sleeve, a load transfer sleeve, a housing, a sleeve, and/or a tubular, may have an upper portion and a lower portion. The term "top" as used herein means in the highest position, e.g., farthest from the ground. The term "bottom" as used herein means in the lowest position, e.g., closest the ground. For example, a cylindrical object, e.g., a disconnect housing, a window sub, a prop sleeve, a load transfer sleeve, a housing, a sleeve, and/or a tubular, may have a top portion and a bottom portion.

The term "window" as used herein is defined as an aperture extending through an object, e.g., a window sub.

The term "wireline" as used herein is defined as an electrically conductive cable extendable from surface to a downhole tool. A wireline may also be known as an e-line or smart line.

3. Certain Specific Embodiments

Disclosed herein are downhole disconnect assemblies for disconnecting downhole tubulars, which disconnect assemblies may include: 1) a housing having: a) a first inner surface and a first outer surface; b) an upper socket and a lower socket on the first inner surface; and c) a plurality of radial grooves formed on the first inner surface between the sockets; 2) a window sub having: a) a second inner surface and a second outer surface; b) an upper torque transfer profile and a lower torque transfer profile disposed about the second outer surface for respective slidable mating with the upper and lower sockets on the housing, thereby preventing relative rotation between the window sub and the housing; and c) a window defined between the torque transfer profiles therein; 3) a locking lug disposed in the window sub for locking the window sub to the housing and the sockets, thereby preventing relative longitudinal movement between the window sub and the disconnect housing; 4) a prop sleeve for disengaging the locking lug, thereby allowing for longitudinal movement of the housing relative to the window sub; and 5) a load transfer sleeve for transferring a tensile pre-load to the housing and window sub.

Additionally, disclosed herein are downhole disconnect assemblies for disconnecting downhole tubulars downhole, which disconnect assemblies may include: 1) a housing having an inner surface and a groove disposed in the inner surface; 2) a sub disposed in the housing, the sub having a window aligned with the groove; 3) a locking lug extending through the window and having a projection removably disposed in the groove; 4) a prop sleeve disposed in the sub and releasably coupled to the locking lug; and 5) a load transfer sleeve pushing the housing.

Also, disclosed herein are downhole disconnect assemblies for disconnecting downhole tubulars downhole, which disconnect assemblies may include: 1) a housing comprising: a) a first set of socket surfaces; b) a second set of socket surfaces; and c) a groove disposed between the first set of socket surfaces and the second set of socket surfaces of the housing; 2) a sub disposed in the housing, the sub comprising: a) a first set of socket surfaces; b) a second set of socket surfaces; and c) a window disposed between the first set of socket surfaces and the second set of socket surfaces of the sub; and 3) a locking lug extended through the window into the groove.

Furthermore, disclosed herein are downhole disconnect assemblies for disconnecting downhole tubulars downhole, which disconnect assemblies may include: 1) deploying a dart down the downhole tubular string; 2) coupling the dart to a prop sleeve of a tubular disconnect assembly disposed on the downhole tubular string; 3) pumping a first volume of fluid into the downhole tubular string; 4) displacing the prop sleeve axially; and 5) forcing, with a housing of the tubular disconnect assembly, a locking lug away from the housing.

In any one of the methods or structures disclosed herein, the load transfer sleeve may be abutted against the housing.

In any one of the methods or structures disclosed herein, the load transfer sleeve may have a lip pushing the housing.

In any one of the methods or structures disclosed herein, the load transfer sleeve may be pushing the sub.

In any one of the methods or structures disclosed herein, the load transfer sleeve may be abutted against the sub.

In any one of the methods or structures disclosed herein, a portion of the sub may extend through the load transfer sleeve.

In any one of the methods or structures disclosed herein, the load transfer sleeve may be disposed around the sub.

In any one of the methods or structures disclosed herein, the window may be adjacent the groove.

In any one of the methods or structures disclosed herein, a surface of the first set of socket surfaces of the housing may be capable of being abutted against a surface of the first set of socket surfaces of the sub.

In any one of the methods or structures disclosed herein, a surface of the second set of socket surfaces of the housing may be capable of being abutted against a surface of the second set of socket surfaces of the sub.

In any one of the methods or structures disclosed herein, the housing may further include a socket surface having two surface portions forming an angle less than 180 degrees.

In any one of the methods or structures disclosed herein, the sub may further include a socket surface having two surface portions forming an angle less than 180 degrees.

In any one of the methods or structures disclosed herein, the housing may further include a radiused connecting surface.

In any one of the methods or structures disclosed herein, the housing may further include one or more connecting surfaces, wherein none of the connecting surfaces may be in physical contact with the sub.

In any one of the methods or structures disclosed herein, the locking lug may have projections coupled to the box threads of the housing.

In any one of the methods or structures disclosed herein, the locking lug may be capable of sliding in the through the window towards the central axis of the window sub.

In any one of the methods or structures disclosed herein, the locking lug may include a groove for receiving a portion of the prop sleeve.

In any one of the methods or structures disclosed herein, the window sub may have a set of window socket surfaces connected to forming a polygon.

In any one of the methods or structures disclosed herein, the prop sleeve may be slidably coupled to the window sub.

In any one of the methods or structures disclosed herein, the prop sleeve may be shearably coupled to the window sub.

In any one of the methods or structures disclosed herein, the prop sleeve may include a groove for receiving a portion of the locking lug.

In any one of the methods or structures disclosed herein, axial force may be applied by the load transfer sleeve to the housing.

In any one of the methods or structures disclosed herein, axial force may be applied by the housing to the locking lug.

Any one of the methods disclosed herein may further include sliding a portion of the locking lug through a window of a sub.

Any one of the methods disclosed herein may further include receiving a portion of the prop sleeve in a groove disposed in the locking lug.

Any one of the methods disclosed herein may further include receiving a portion of the locking lug in a groove disposed in the prop sleeve.

Any one of the methods disclosed herein may further include abutting a housing socket surface on the housing against window a socket surface on a sub.

Any one of the methods disclosed herein may further include shearing a shear pin coupled to the prop sleeve and a window sub.

Any one of the methods disclosed herein may further include lifting the downhole tubular string.

Any one of the methods disclosed herein may further include rotating the downhole tubular string.

Any one of the methods disclosed herein may further include decoupling the housing from a window sub.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of downhole tubular disconnect assemblies shown in the drawings, which relate to assemblies, elements and parts that can be part of a downhole disconnect assembly, and methods for disconnecting a downhole tubular from another downhole assembly. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

FIG. 1A illustrates a profile view of a portion of a downhole tubular string. The portion of the downhole tubular string include a tubular disconnect assembly 102 disposed thereon. The tubular disconnect assembly 102 may include a disconnect housing 104, a window sub (not shown), a prop sleeve (not shown), locking lugs (not shown), a load transfer sleeve 112, an upper cap 114*a*, and a lower cap 114*b*. The upper cap 114*a* may be coupled to an upper portion of the tubular string, e.g., a set of tubulars. The lower cap 114*b* may be coupled to an upper portion of the tubular string, e.g., a set of tubulars.

In some disconnect assembly versions, caps 114*a*, 114*b* may be omitted. Instead, a disconnect housing 104 of a tubular disconnect assembly 102 may be directly coupled to an upper portion of a tubular string. In addition, a window sub 106 of the tubular disconnect assembly 102 may be directly coupled to a lower portion of the tubular string.

In any case, together, the upper portion of the tubular string, the tubular disconnect assembly 102, and the lower portion of the tubular string may be coupled to form a continuous downhole tubular string.

Figure 1B:
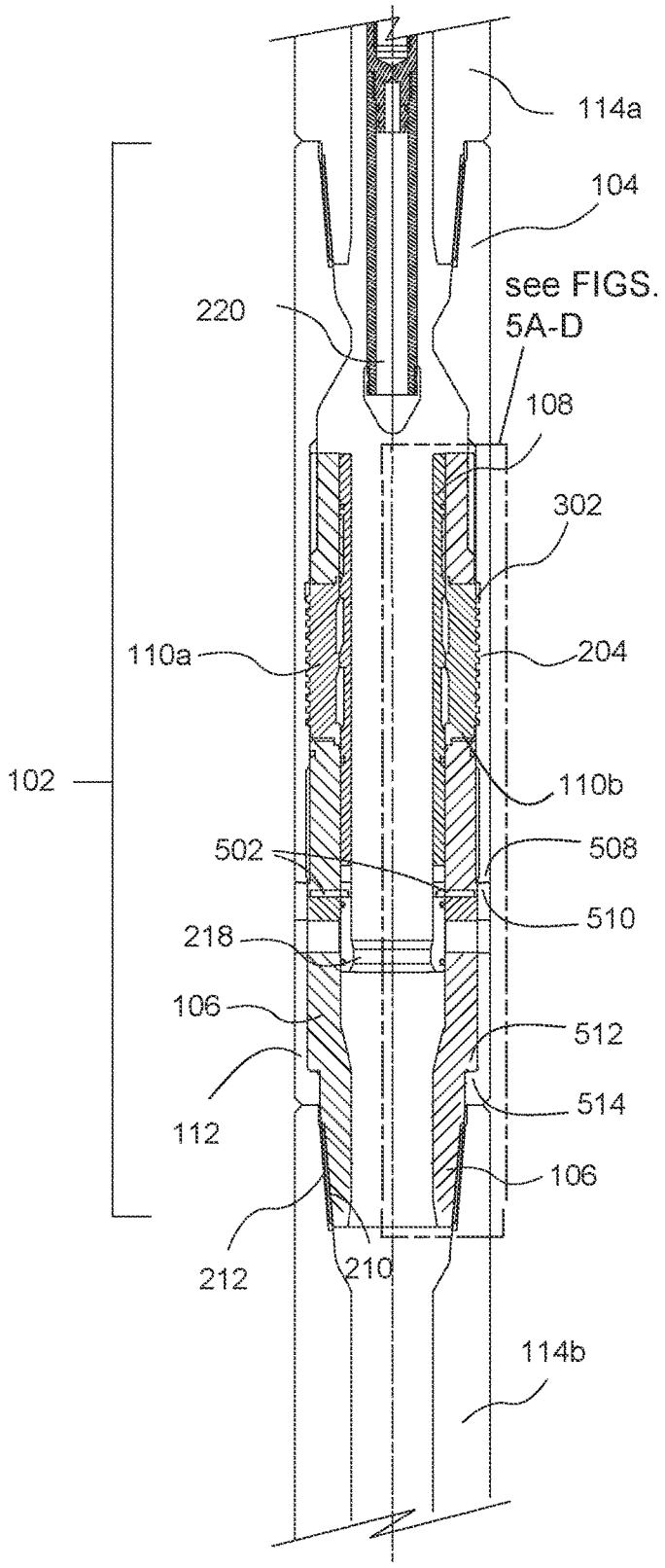
FIG. 1B illustrates a cross-sectional side view of a tubular disconnect assembly in a locked position.

FIG. 1B illustrates a cross-sectional side view of a tubular disconnect assembly 102 in a locked position. The tubular disconnect assembly 102 may include a disconnect housing 104, a window sub 106, a prop sleeve 108, locking lugs 110*a*, 110*b*, and a load transfer sleeve 112. The window sub 106 may have a portion disposed concentrically in the disconnect housing 104. A lower end of the window sub 106 may be extended through a lower end of the disconnect housing 104.

Each locking lug 110 may be slid through a window 208 (FIG. 2 and FIG. 3) of the window sub 106. In addition, each locking lug 110 may have projections 302 coupled to box grooves 204 disposed in an inner surface of the disconnect housing 104. In some cases, when the locking lugs 110*a*, 10*b* are coupled to the box grooves 204, the window sub 106 would be inhibited from axial movement relative to the disconnect housing 104.

The prop sleeve 108 may be disposed concentrically within the window sub 106. Also, the prop sleeve 108 may be coupled to the window sub 106 via shear pins 502. The shear pins 502 may be extended through the prop sleeve 108 into the window sub 106. Furthermore, the prop sleeve 108 may have one or more outer surfaces abutted against the locking lugs 110*a*, 110*b*. Accordingly, in some cases, the prop sleeve 108 may cause the locking lug 110*a*, 110*b* to remain coupled to the box grooves 204. Thus, the prop sleeve 108, in some cases, may inhibit the locking lugs 110*a*, 110*b* from being moved towards the central axis of the window sub 106. In other words, the prop sleeve 108, in some cases, may inhibit the locking lugs 110*a*, 110*b* from being uncoupled from the box grooves 204.

The load transfer sleeve 112 may be disposed around the lower end of the window sub 106. An upper face 510 of the load transfer sleeve 112 may be abutted against a lower face 508 of the disconnect housing 104. In some versions, washers and/or seals may be disposed between the upper face of the load transfer sleeve 112 and the lower face of the disconnect housing 104. Force applied to the washers and/or seals may create a tight seal between the disconnect housing 104 and the load transfer sleeve 112. Thus, in some cases, the tight seal may inhibit wellbore fluid from ingress into the disconnect housing 104.

A portion of the window sub 106 may have pin threads 210 extended through the load transfer sleeve 112. The pin threads 210 may be threadably coupled to box threads 212 of a lower cap 114*b*. In other versions, the pin threads 210 may be threadably coupled to box threads of a tubular of lower portion of a tubular string.

Figure 2:
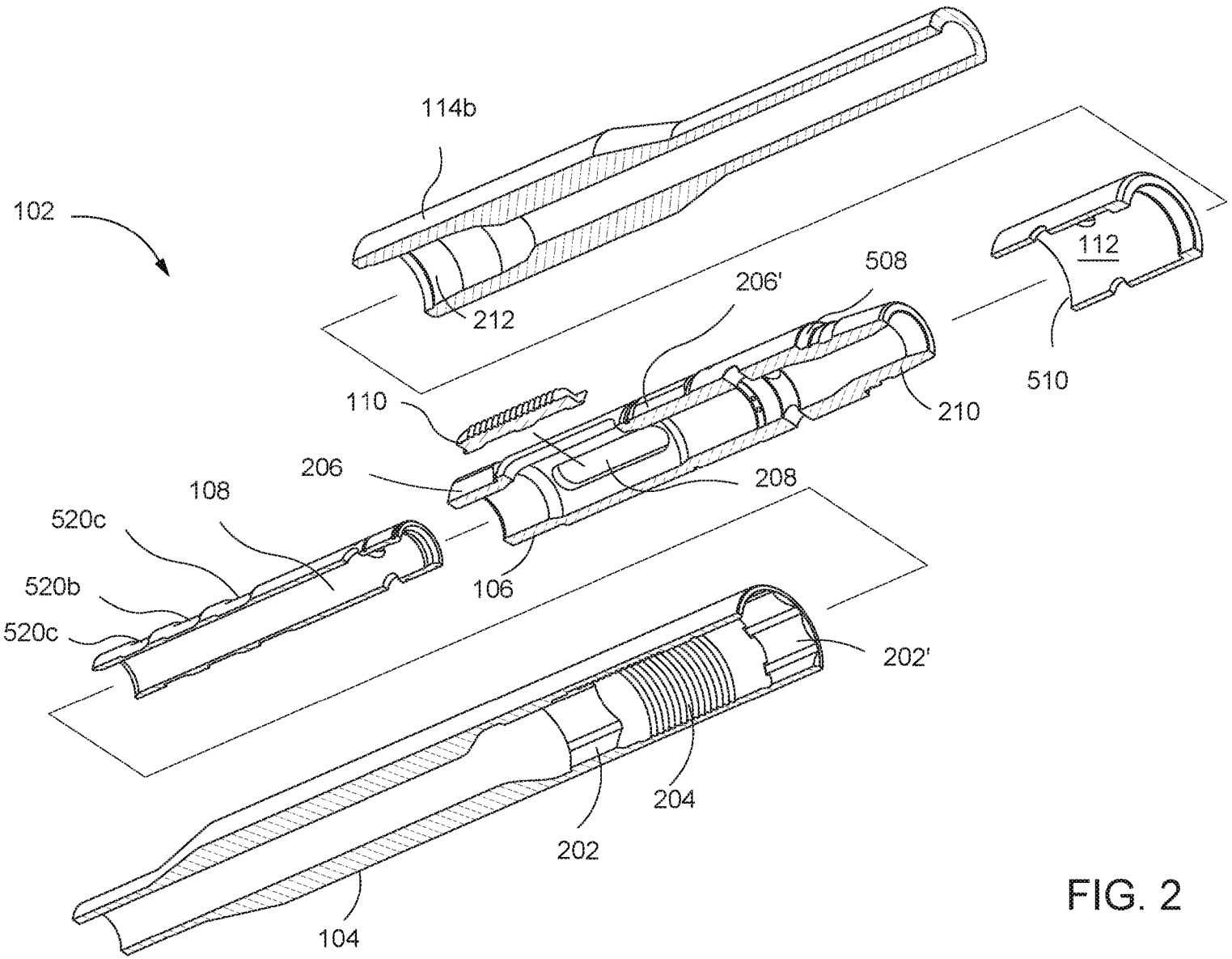
FIG. 2 illustrates an exploded perspective view of a tubular disconnect assembly.

FIG. 2 illustrates an exploded perspective view of a tubular disconnect assembly 102. The tubular disconnect assembly 102 may include a disconnect housing 104, window sub 106, a prop sleeve 108, a locking lug 110, and a load transfer sleeve 112. The window sub 106 may have one or more windows 208. Each window 208 may be disposed between a set of upper window socket surfaces 206 and a set of lower window socket surfaces 206'. In addition, each window 208 may be aligned with the box grooves 204 disposed in the disconnect housing 104.

Figure 3:
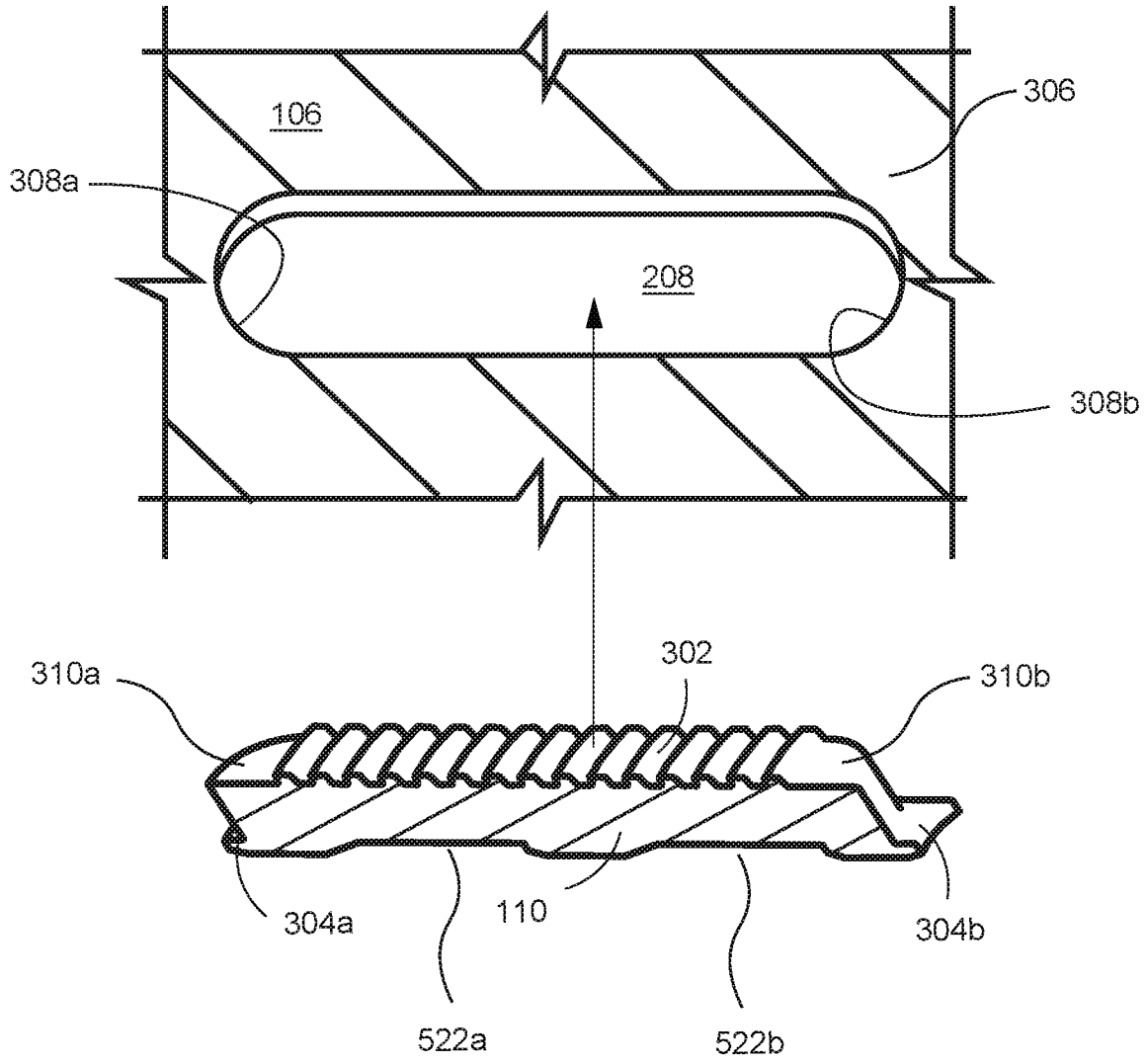
FIG. 3 illustrates a magnified view of a locking lug and a window sub having a window.

Referring to FIG. 3, a window 208 may extend through a window sub 106. Also, a locking lug 110 is capable of being extended through the window 208. Additionally, projections 302 of the locking lug 110 is capable of being slid through the window 208. Also, the locking lug 110 may have feet 304*a*, 304*b* capable of being abutted against an inner surface 306 of the window sub 106. Accordingly, the feet 304*a*, 304*b*, in some cases, may inhibit the locking lug 110 from being completely passed through the window 208.

In addition, the window 208 may have ends 308*a*, 308*b* that are radiused, e.g., rounded, curved, semicircle, and/or hemispherical. Also, the locking lug 110 may have ends 310*a*, 310*b* that are radiused, e.g., rounded, curved, semicircle, and/or hemispherical. When slid through the window 308, the ends 310*a*, 310*b* of the locking lug 110 would be abutted against the ends 308*a*, 308*b* of the window 208.

Referring to FIG. 1 and FIG. 2, the disconnect housing 104 may have an inner surface and an outer surface. The disconnect housing 104 may have on its inner surface a set of upper housing socket surfaces 202, a set of lower housing socket surfaces 202', and box grooves 204. The box grooves 204 may be disposed between the set of housing socket surfaces 202 and the set of lower housing socket surfaces 202'.

The window sub 106 may have an inner surface and an outer surface. The window sub 106 may have a set of upper window socket surfaces 206, a set of lower window socket surfaces 206', and one or more windows 208. The one or more windows 208 may be disposed between the set of window socket surfaces 206 and the set of lower window socket surfaces 206'.

When the window sub 106 is disposed in the disconnect housing 104, the set of upper window socket surfaces 206 of the window sub 106 would be aligned with the set of upper housing socket surfaces 202 of the disconnect housing 104. Additionally, the set of lower window socket surfaces 206' of the window sub 106 would be aligned with the set of lower housing socket surfaces 202' of the disconnect housing 104.

If the disconnect housing 104 were rotated (clockwise or counterclockwise) relative to the window sub 106, the set of housing socket surfaces 202, 202' would respectively be abutted against the set of window socket surfaces 206, 206'. Accordingly, the window sub 106 would be inhibited from rotation relative to the disconnect housing 104.

The discussion of FIGS. 4A-E below may apply to the corresponding set of upper housing socket surfaces 202 and set of upper window socket surfaces 206 in FIG. 2. Furthermore. the discussion of FIGS. 4A-E below may also apply to the corresponding set of lower housing socket surfaces 202' and set of lower window socket surfaces 206' in FIG. 2.

Figure 4A:
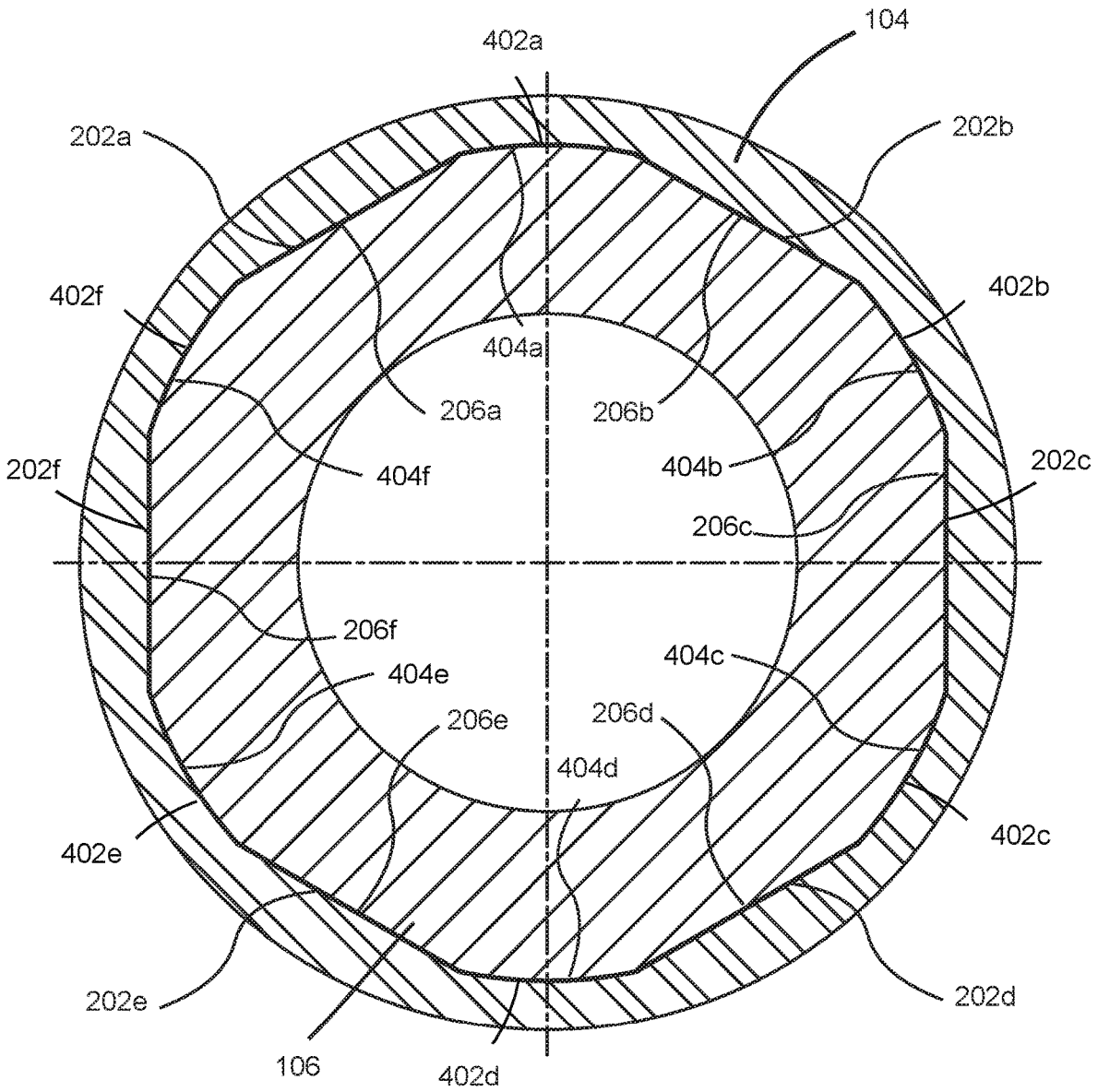
FIG. 4A illustrates a top cross-sectional view of a window sub disposed concentrically in a disconnect housing, taken on the line A-A and/or B-B of FIG. 1 looking in the direction of the arrows.

FIG. 4A illustrates top cross-sectional view of a window sub 106 disposed concentrically in a disconnect housing 104. The disconnect housing 104 may have housing socket surfaces 202*a-f*. Each housing socket surface 202 of the disconnect housing 104 is preferably planar. In addition, the disconnect housing 104 may have housing connecting surfaces 402*a-f*. A housing connecting surface 402 may be connected to two housing socket surfaces 202. For example, the housing socket surfaces 202*a*, 202*b* may be coupled to the housing connecting surface 406*b*.

The window sub 106 may have window socket surfaces 206*a-f*. Also, the window sub 106 may have window connecting surfaces 404*a-f*. Each window socket surface 206 of the window sub 106 is preferably planar. For example, the window socket surfaces 206*a*, 206*b* may be coupled to the window connecting surface 404*b*.

The window socket surfaces 206*a-f* may be aligned with housing socket surfaces 202*a-f*, respectively. Additionally, the window connecting surfaces 404*a-f* may be aligned with the housing connecting surfaces 402*a-f*, respectively. A window connecting surface 404 may be connected to two window socket surfaces 206.

When the disconnect housing 104 is rotated relative to the window sub 106, portions of the housing socket surfaces 202 would be abutted against portions of the window socket surfaces 206, respectively. Additionally, portions of the housing connecting surfaces 402 would be abutted against portions of the window connecting surfaces 404, respectively.

In some versions, each housing socket surface 206 may be radiused. In those versions, each window socket surface 206 may be radiused.

Figure 4B:
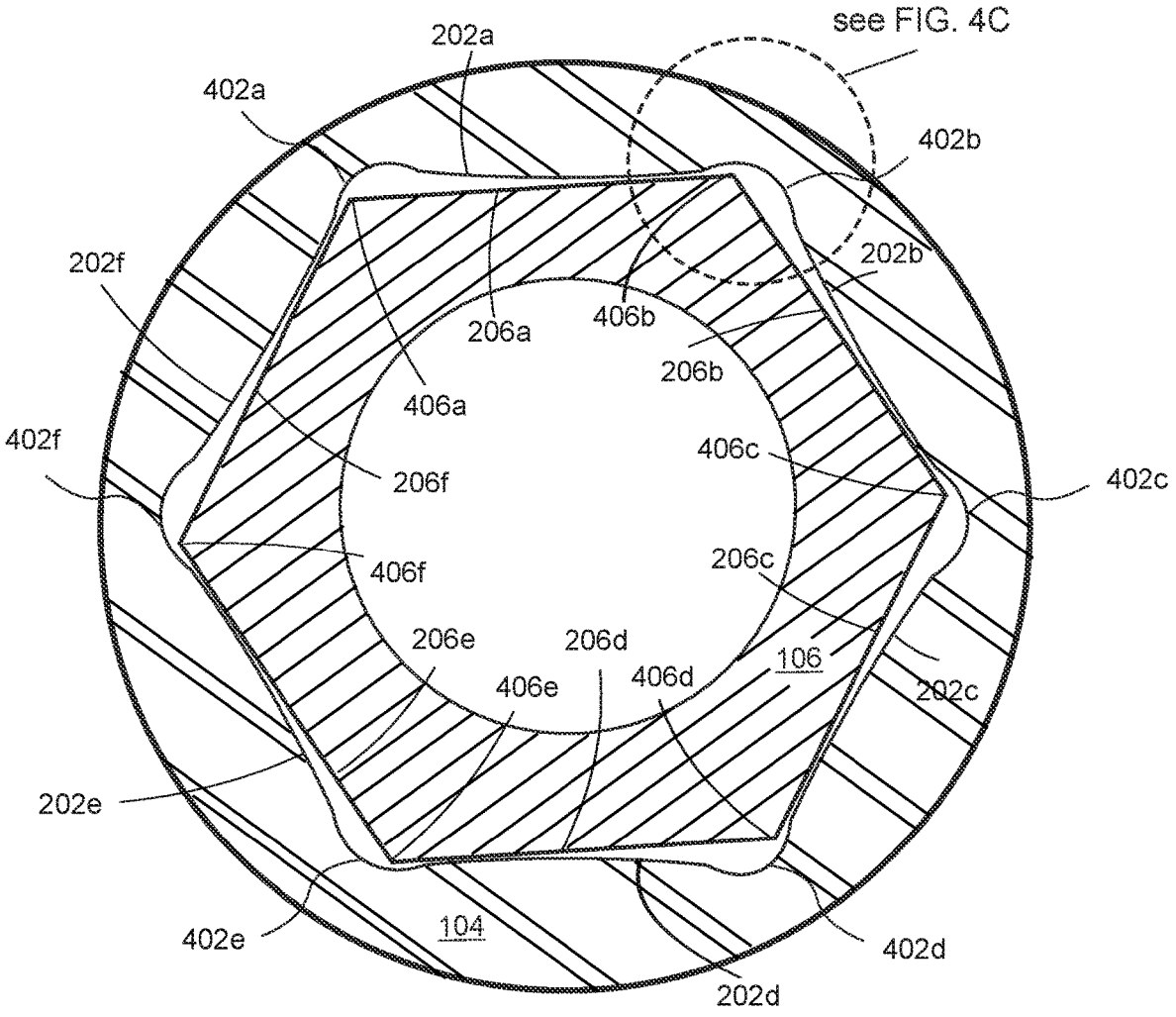
FIG. 4B illustrates a top cross-sectional view of another version of a window sub disposed in a disconnect housing, taken on the line A-A and/or B-B of FIG. 1 looking in the direction of the arrows.

FIG. 4B illustrates a top cross-sectional view of another version of a window sub 106 disposed in a disconnect housing 104. Window socket surfaces 206*a-f* of the window sub 106 may be respectively aligned with housing socket surfaces 202*a-f* of the disconnect housing 104. Each housing socket surface 202 is preferably radiused. Moreover, each housing socket surface 202 may be curved inwardly relative to the central axis of the disconnect housing 104. In some versions, the housing socket surface 202*a-f* may be planar.

Each pair of housing socket surfaces 204 may be connected to a radiused connecting surfaces 402. For example, housing socket surfaces 204*a*, 204*b* may be coupled to ends of a radiused connecting surfaces 402*a*. The radiused connecting surfaces 402*a-f* may be equally spaced from one another. The radiused connecting surfaces 402*a-f* may be spaced at about 30, 45, or 60-degree intervals.

The housing socket surfaces 204*a-f* and the radiused housing connecting surfaces 402*a-f* may form an aperture in the disconnect housing 104. The aperture may receive the window socket surfaces 206*a-f* of the window sub 106.

Figure 4C:
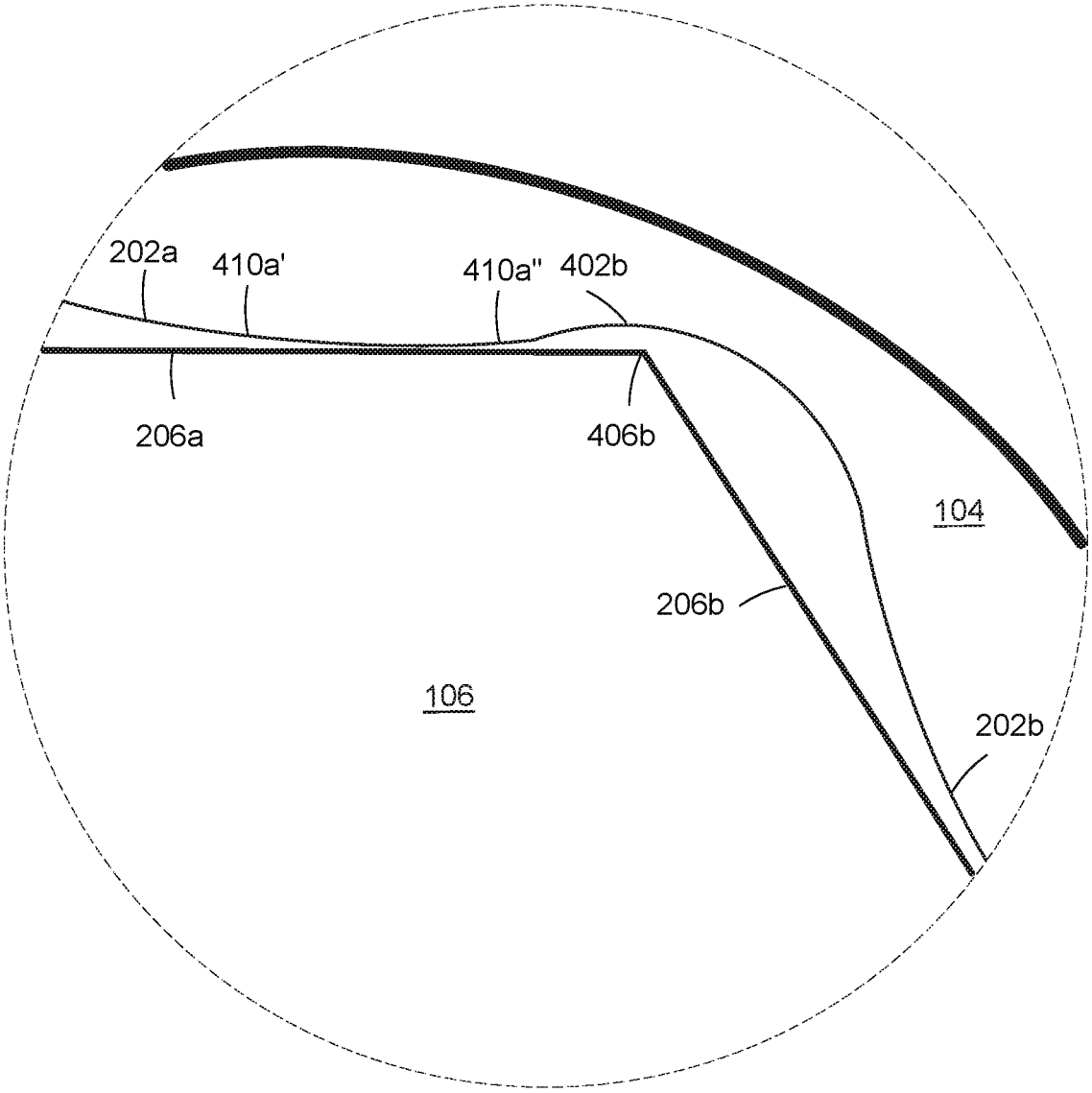
FIG. 4C illustrates a magnified view of a portion of a window sub disposed in a disconnect housing, wherein the disconnect housing has a radiused corner.

Referring to FIG. 4B and FIG. 4C, each window socket surface 206 is preferably planar. When the window sub 106 is rotated relative to the housing 104, the window socket surfaces 206*a-f* would be respectively abutted against the housing socket surfaces 202*a-f*. A portion of each window socket surface 206 is capable of being abutted against a portion of a respective housing socket surface 202. Accordingly, the window sub would be inhibited from further rotation relative to the disconnect housing 104.

Furthermore, a window corner 406 may be formed by a pair of adjacent window socket surfaces 206. For example, the window socket surfaces 206*a*, 206*b* may be coupled, e.g., intersected, to form a window corner 406*b*. Thus, the window socket surfaces 206*a-f* may be connected to form a cross-section having a shape of a hexagon.

In various versions, the disconnect housing 104 and window sub 106 may have corresponding socket surfaces of varying numbers. Thus, the socket surfaces may form different polygonal cross-sections. Each cross-section may have a shape of a triangle, a square, a rectangle, a pentagon, a hexagon, a heptagon, or an octagon.

Furthermore, each window corner 406 may be disposed adjacent to a respective radiused housing connecting surface 402. However, in some cases, no window corner 406 may be in physical contact with any radiused housing connecting surface 402.

FIG. 4D illustrates an alternative version of a window sub 106 disposed concentrically in a disconnect housing 104. The disconnect housing 104 may have housing socket surfaces 202*a-f*. Each housing socket surface 202 is preferably planar. In addition, the disconnect housing 104 may have housing connecting surfaces 402*a-f*. Each housing connecting surface 402 may be planar. Also, each housing connecting surface 402 may have a width less than that of a housing socket surface 202. A housing connecting surface 402 may be connected to two housing socket surfaces 202. For example, the housing socket surfaces 202*a*, 202*b* may be coupled to the housing connecting surface 402*b*.

The window sub 106 may have window socket surfaces 206*a-f*. The window socket surfaces 206*a-f* of the window sub 106 may be aligned with housing socket surfaces 202*a-f* of the disconnect housing 104, respectively. Each window socket surface 206 may be planar. Additionally, a window socket surface 206 may be adjacent to a housing socket surface 202. Also, the window sub 106 may have window connecting surfaces 404*a-f*. Each window connecting surface 404 may be connected to two window socket surfaces 206. For example, the window socket surfaces 206*a*, 206*b* may be coupled to the window connecting surface 404*b*. Each window connecting surface 404 may be adjacent to a housing connecting surface 402. Each connecting surface 404 may be planar.

Furthermore, each window connecting surface 404 may be disposed adjacent to a respective housing connecting surface 402. However, in some cases, no window connecting surface 404 may be in physical contact with any housing connecting surface 402. Moreover, in some cases, no portion of the window sub 106 is in physical contact with any housing connecting surface 402.

When the disconnect housing 104 is rotated relative to the window sub 106, portions of the housing socket surfaces 202 would be abutted against portions of the window socket surfaces 206, respectively.

In various versions, the window socket surface 206*a* may not be a planar surface. In those cases, each window socket surface 206 of a window sub 106 may be formed from two or more surface portions 408. Referring to FIG. 4E, a window socket surface 206*a* may be formed from two window socket surface portions 408*a*', 408*a*". The window socket surface portions 408*a*', 408*a*" may be connected to form an angle less than 180 degrees, e.g., 165, 170, 175, 177, or 178 degrees. The window socket surface portion 408*a*" is preferably shorter than the socket surface portion 408*a*'. The window socket surface portion 408*a*" may have a length equal to about 20-30 percent (preferably 26 percent) of a combined length of the window socket surface portions 408*a*', 408*a*".

When the disconnect housing 104 is rotated relative to the window sub 106, portions of the housing socket surfaces 202*a*, 202*b* would be abutted against portions of the window socket surfaces 206*a*, 206*b*, respectively. For example, as shown in FIG. 4E, the window socket surface portion 408*a*" may be abutted against a portion of the housing socket surface 202*a* of the tubular disconnect assembly 102. Alternatively, when the window sub is rotated in a clockwise direction, the window socket surface portion 408*a*' would instead be abutted against the housing socket surface 202*a*.

Accordingly, torque, e.g., rotational force, imparted to the disconnect housing 104 may be transferred to the window sub 106. Referring to FIGS. 1, 2, and 4D, torque may be transferred via physical contact between the portions of housing socket surfaces 202*a*, 202*b* and respective of window socket surface portions 408*a*, 408*b*. However, in some cases, torque is not transferred to portions of the window sub 106 through which a window 208 (FIG. 2) is disposed.

Figure 5A:
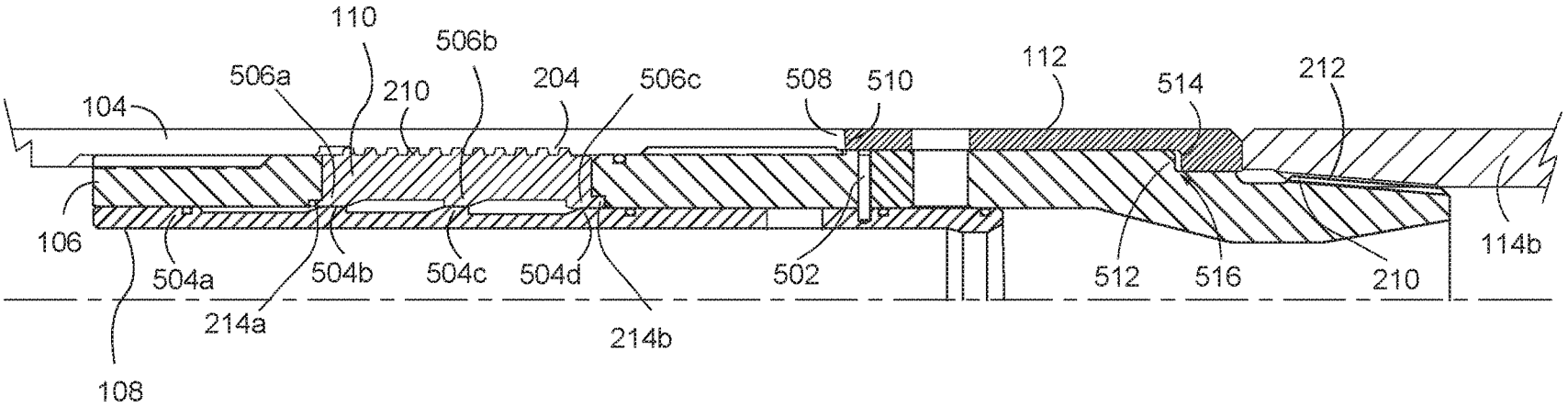
FIG. 5A illustrates a cross-sectional side view of a tubular disconnect assembly in a pre-lock configuration.

FIG. 5A illustrates a tubular disconnect assembly 102 in a pre-lock configuration. The tubular disconnect assembly 102 may include a disconnect housing 104, a window sub 106, a prop sleeve 108, a locking lug 110, a load transfer sleeve 112, and a lower cap 114*b*.

The locking lug 110 may be extended through the window sub 106. In addition, the locking lug may have projections 302 coupled to box grooves 204 disposed in an inner surface of the disconnect housing 104. In some cases, when the locking lugs 110*a*, 110*b* are coupled to the box grooves 204, the window sub 106 would be inhibited from axial movement relative to the disconnect housing 104.

The prop sleeve 108 may be disposed concentrically within the window sub 106. Also, the prop sleeve 108 may be coupled to the window sub 106 via a shear pin 502. The shear pin 502 may be extended through the prop sleeve 108 into the window sub 106. Furthermore, the prop sleeve 108 may have outer surface portions 504*a-d*. The outer surface portions 504*b-d* may be respectively abutted against inner surface portions 506*a-c* of the locking lug 110. The prop sleeve 108 may cause the locking lug 110 to remain coupled to the box grooves 204. Accordingly, the prop sleeve 108, in some cases, may inhibit the locking lug 110 from being slid towards the central axis of the window sub 106. In other words, in the pre-lock configuration, the prop sleeve 108 and the locking lug 110 may inhibit the window sub 106 from being slid axially relative the disconnect housing 104.

Additionally, the load transfer sleeve 112 may be disposed around the lower end of the window sub 106. An upper face

510 of the load transfer sleeve 112 may be abutted against a lower face 508 of the disconnect housing 104.

In some versions, one or more washers and/or seals may be disposed between the upper face 510 of the load transfer sleeve 112 and the lower face 508 of the disconnect housing 104. However, force may still be transferred from the load transfer sleeve 112 through the one or more washers and/or seals to the disconnect housing 104.

Still referring to FIG. 5A, in the pre-lock configuration, the window sub 106 may have a downward-facing shoulder 512 that, in some cases, may not be in physical contact with an upward-facing shoulder 514 of the load transfer sleeve 112. Thus, a clearance 516 may exist between the downward-facing shoulder 512 and the upward-facing shoulder 514.

Figure 5B:
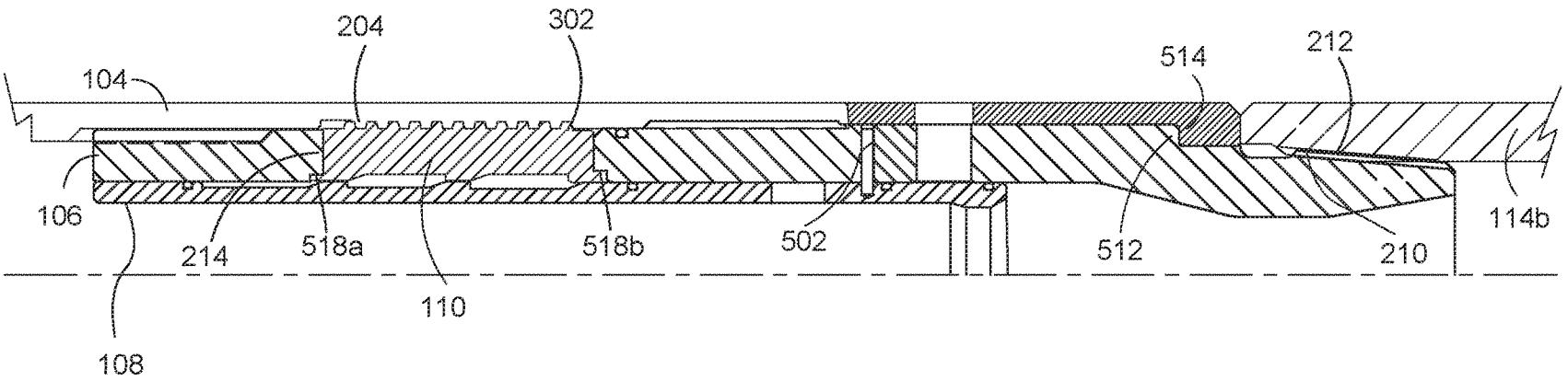
FIG. 5B illustrates a cross-sectional side view of a tubular disconnect assembly in a locked configuration.

FIG. 5B illustrates a tubular disconnect assembly 102 in a locked configuration. A lower cap 114*b* may be coupled to a lower end of the window sub 106. The lower cap 114*b* may have box threads 212 coupled to pin threads 210 of the window sub 106. The box threads 212 may be turned relative to the pin threads 210 to cause an upper end of the lower cap 114*b* to be abutted and/or pushed against a lower end of the load transfer sleeve 112. Accordingly, force applied to the lower cap 114*b* may be transferred to the lower shoulder 512 of the window sub 106. Additionally, the force may cause the load transfer sleeve 112 to be abutted against a disconnect housing 104. An upper face 510 of the load transfer sleeve 112 may be abutted against a lower face 508 of the disconnect housing 104. Also, an upward-facing shoulder 514 of the load transfer sleeve 112 may be abutted against the downward-facing shoulder 512 of the disconnect housing 104. Thus, the force may cause the load transfer sleeve 112 to be compressed axially.

Figure 5C:
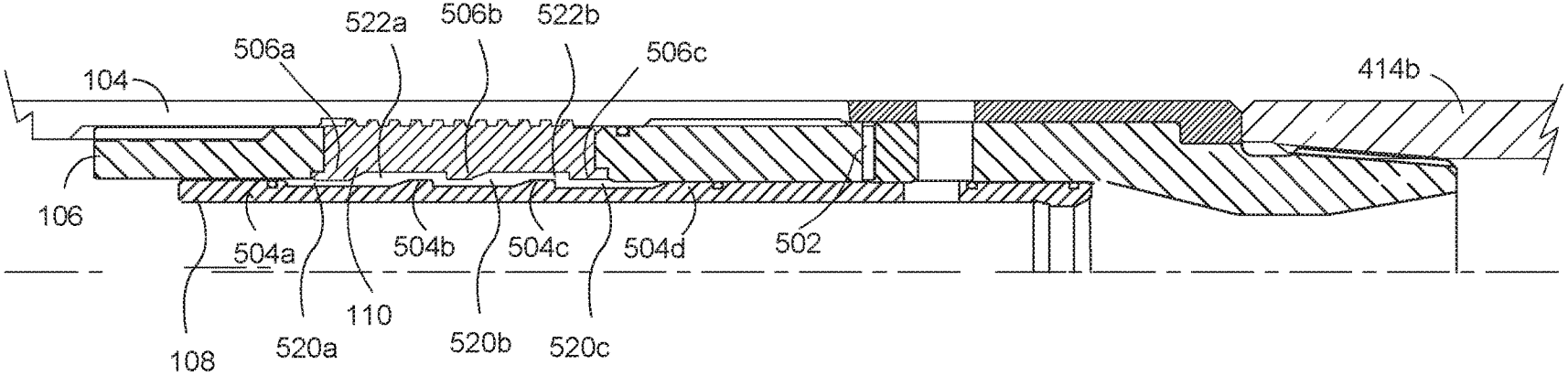
FIG. 5C illustrates a cross-sectional side view of a tubular disconnect assembly in an actuated configuration.

FIG. 5C illustrates a tubular disconnect assembly 102 in an actuated configuration. The tubular disconnect assembly 102 may include a prop sleeve 108 slid down relative to a disconnect housing 104. The prop sleeve 108 may have an inner surface and an outer surface. The outer surface of the prop sleeve 108 may have outer surface portions 504*a-d*. The outer surface portions 504*a-d* may define grooves 520*a-c* of the prop sleeve 108.

The tubular disconnect assembly 102 may also include a locking lug 110. The locking may have inner surface portions 506*a-c*. The inner surface portions 506*a-c* may define grooves 522*a-b*. In the actuated configuration, the inner surface portions 504*b-c* may be aligned in the grooves 522*a-b*, respectively. Also, the inner surface portions 506*a-c* may be aligned with grooves 520*a-c*.

Figure 5D:
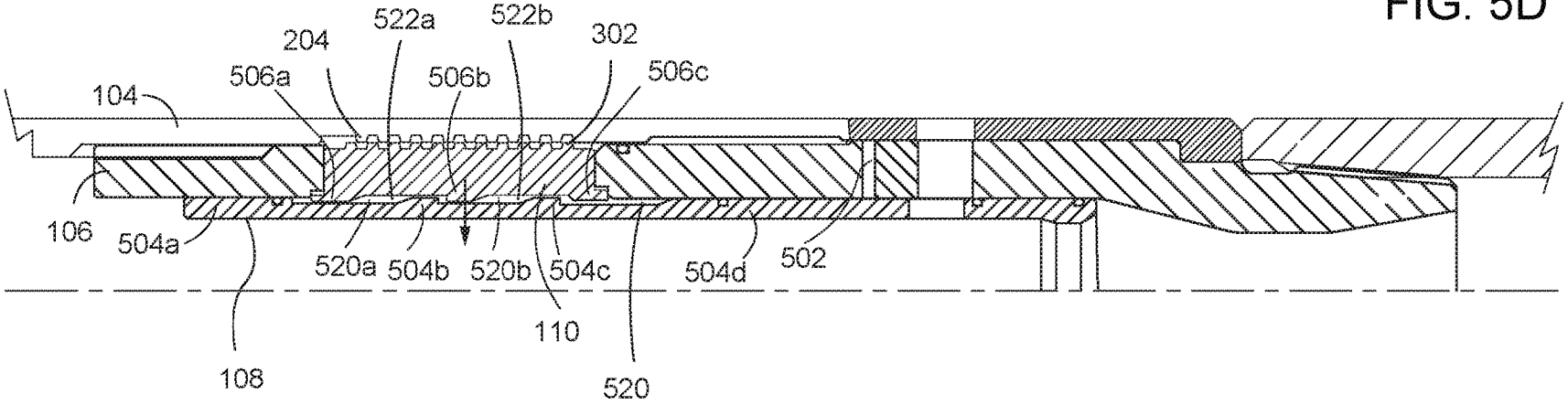
FIG. 5D illustrates a cross-sectional side view of a tubular disconnect assembly in an unlocked configuration.

FIG. 5D illustrates a tubular disconnect assembly 102 in an unlocked configuration. The tubular disconnect assembly 102 may include a locking lug 110. The locking lug 110 may have projections 302 uncoupled from box grooves 204 dispose in an disconnect housing 104. In addition, the locking lug 110 may have inner surface portions 506*a-c* received in grooves 520*a-c* of a prop sleeve 108, respectively. Conversely, the prop sleeve 108 may have outer surface portions 504*b-c* disposed in grooves 522*a-b*, respectively. Thus, in the unlocked configuration, the disconnect housing 104 may be slid away from the window sub 106.

The views of FIG. 6 illustrate a sequence of disconnecting a downhole tubular string via a tubular disconnect assembly 102. An operator may perform the following steps to disconnect a downhole tubular string, e.g., casing, drill pipe, or liner hanger, that may include the tubular disconnect assembly 102 coupled thereto. The tubular disconnect assembly 102 may be coupled to a portion of the downhole tubular string at the surface and "tripped" downhole prior to drilling. Moreover, the tubular disconnect assembly 102 may be in a locked configuration (see FIG. 5A).

As shown in FIG. 5A, in the pre-lock position, a load transfer sleeve 112 may be compressed by a cap 114*b* threadably coupled to a window sub 106. Additionally, box grooves 204 of a disconnect housing 104 may abutted against projections 302 of a locking lug 110. The locking lug 110 may be disposed in a window 208 of the window sub 106. In other words, force may be applied to the projections 302 via the box grooves 204. The projections 302, in some cases, may not be uncoupled from the box grooves 204 because outer surfaces 504*b-d* of the prop sleeve 108 is abutted against inner surfaces 506*a-c* of the locking lug 110.

Figures 6A, 6B, 6C, 6D, 6E:
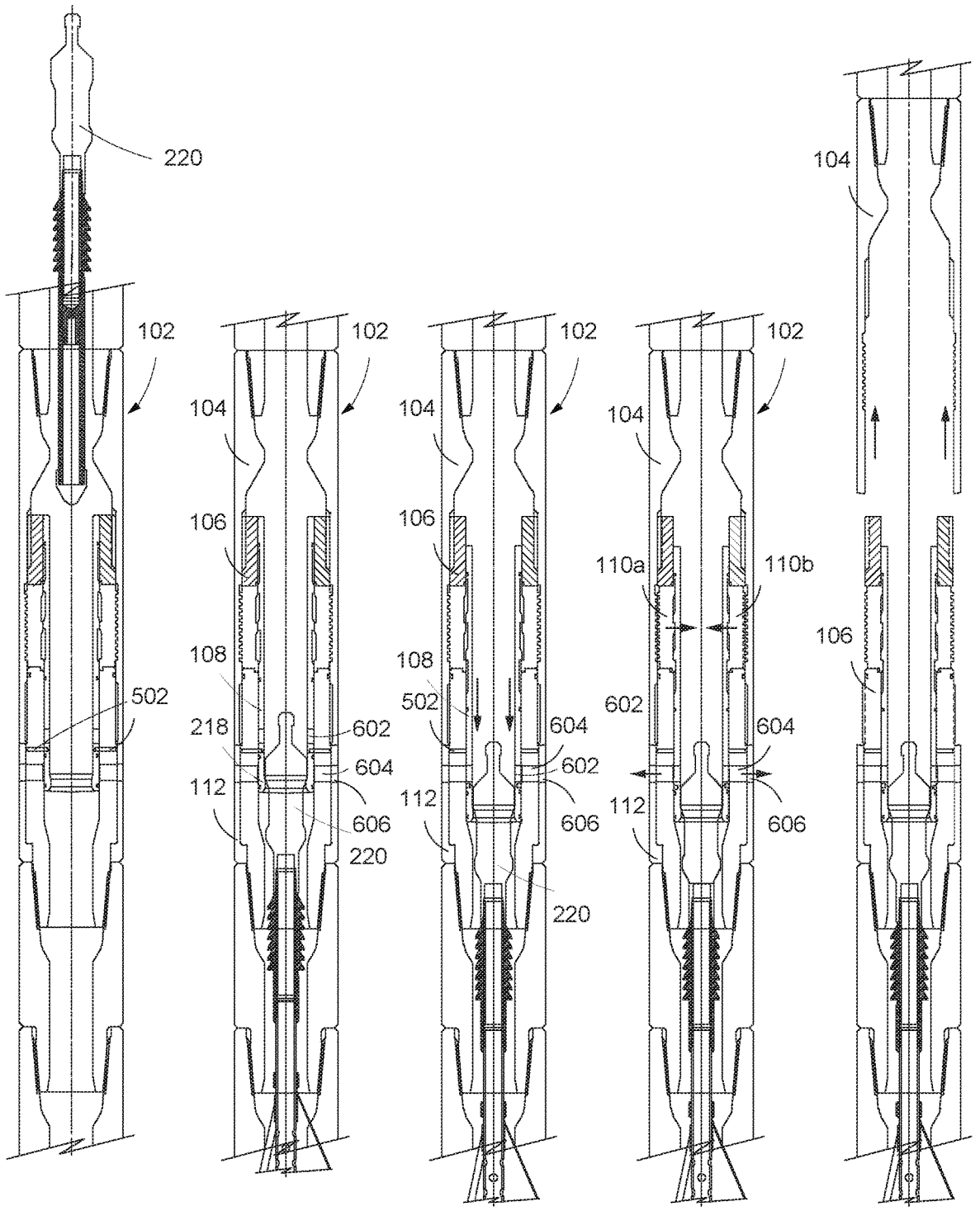
FIG. 6A illustrates a cross-sectional side view of a tubular disconnect assembly in a locked configuration receiving a dart.
FIG. 6B illustrates a cross-sectional side view of a tubular disconnect assembly having a dart landed on a prop sleeve.
FIG. 6C illustrates a cross-sectional side view of a tubular disconnect assembly having a prop sleeve slid down a window sub.
FIG. 6D illustrates a cross-sectional side view of a tubular disconnect assembly having locking lugs uncouple from a window sub.
FIG. 6E illustrates a cross-sectional side view of a tubular disconnect assembly having a disconnect housing uncoupled from a window sub.

Referring to FIG. 5A and FIG. 6A, the operator may first deploy, e.g., drop via freefall or pump in fluid, a dart 220 down the downhole tubular string. The operator may place the dart 220 into an opening of the downhole tubular string at the surface. The operator may release the dart 220 without pumping any fluid. Gravity may cause the dart 220 to fall down the downhole tubular string. Preferably, the operator may pump the dart 220 in a first volume of fluid down the downhole tubular string at a pump down fluid flow rate. The dart 220 may be pushed (via the fluid) down the downhole towards disconnect assembly 102.

The first volume of fluid may be as little as 30 barrels, 35 barrels, 40 barrels, 45 barrels or as high as 50 barrels, 55 barrels, 60 barrels, 65 barrels, 70 barrels or higher. The first volume of fluid may be pumped at a pump down fluid flow rate.

Referring to FIG. 5B and FIG. 6B, the dart may be landed on a landing seat 218 of a prop sleeve 108. Fluid may flow against the dart 220 and the landing seat 218. Also, pressure may be exerted on the dart 220 and/or the landing seat 218 from the flow of the fluid. However, at the pump down fluid flow rate, the pressure exerted on the dart 220 and/or the landing seat 218, in some cases, may not be greater than force required to shear, e.g., break or snap, one or more pins 502. Therefore, in some cases, pumped at the pump down fluid flow rate, the fluid may not push the prop sleeve 108 down.

Consequently, the operator may detect an increase in pressure in the fluid because the flow of the fluid is inhibited by the dart 220 coupled to the prop sleeve 108. Next, the operator may pump a second volume of fluid down the downhole tubular string. The second volume of fluid may be as little as 0.25 barrel, 0.5 barrel, 0.75 barrel, 1 barrel or as high as 2 barrels, 3, barrels, 4 barrels, or higher. The second volume of fluid may be pumped at an actuation fluid flow rate. The actuation fluid flow rate may be less than the pump down fluid flow rate.

The first volume of fluid and second volume of fluid together may exert fluid pressure on the dart 220 and/or landing seat 218 that is greater than pressure required to shear, e.g., break or snap, the one or more pins 502. Correspondingly, downward fluid pressure against the dart 220 and/or landing seat 218 may cause the prop sleeve 108 to shear the shear pin 502. Accordingly, the shear prop sleeve may be slid down the window sub 106, as shown in FIG. 6C.

Additionally, one or more ports 602 of the prop sleeve 106, one or more ports 604 of the window sub 106, and one or more ports 606 of a load transfer sleeve 112 may be respectively aligned. The fluid may flow through the ports 602, 604, 606.

Referring to FIGS. 5C and 6C, outward-facing grooves 520*a-c* of the prop sleeve 108 may respectively aligned with inner surface portions 506*a-c* of a locking lug 110. The locking lug may be disposed in a window 208 of the window sub 106. Additionally, inward-facing grooves 522*a*, 522*b* of the locking lug 110 may be respectively aligned with outer surface portions 504*b*, 504*c* the prop sleeve 108. The tubular disconnect assembly 102 is now in an actuated configuration.

Referring to FIG. 5D and FIG. 6D, force transferred from a lower cap 114*b*, to the load transfer sleeve 112, to the disconnect housing 104 may cause threads 204 of the disconnect housing 104 to push against projections 302 of the locking lug 110. The locking lug 110 may be slid away from the disconnect housing because the outward-facing grooves 520*a-c* of the prop sleeve 108 may respectively aligned with inner surface portions 506*a-c* of a locking lug 110 and the inward-facing grooves 522*a*, 522*b* of the locking lug 110 may be respectively aligned with outer surface portions 504*b*, 504*c* the prop sleeve 108. The tubular disconnect assembly 102 is now in an unlocked configuration.

Next, referring to FIG. 6E, the operation may pull on the upper portion of the tubular string to uncouple the disconnect housing 104 from the window sub 106.

Alternate versions of tubular disconnect assemblies may be described in reference to the views of FIG. 1-6 below.

This disclosure is directed to downhole tubular disconnect assemblies that may reduce applied stresses between components to mitigate failure of the components. The downhole tubular disconnect assemblies may be described as apparatuses for disconnecting a lower drill string, e.g., a drill collar or a drill pipe, from an upper drill string portion, such as a length of drill pipe.

The downhole tubular disconnect assemblies may include a disconnect housing and a locking assembly. The locking assembly further comprises a window sub, a locking lug, a prop sleeve, and a load transfer sleeve.

The disconnect housing may define a radial grooved surface between a pair of polygonal-shaped sockets. The window sub may be positioned in the disconnect housing and may define a mating torque transfer profiles for engagement with the sockets of the disconnect housing.

The window sub may define multiple longitudinal windows and circulating ports therein. A locking lug may be disposed in each window of the window sub to engage the window. The locking lug may also be extended pass the window to engage with the grooves in the disconnect housing to prevent the window sub from moving relative to the disconnect housing. The windows in the window sub, along with the lugs disposed therein, may be spaced between the torque transfer profiles such that any torque transmitted therebetween is not applied to the windows or lugs.

The prop sleeve may have a plurality of bosses to mate with the internal surfaces of the locking lugs. The prop sleeve may be shearably secured on a second inner surface of the window sub and has a chamfered internal seat to engage an actuating device, such as a drop ball or dart. The sleeve may slide downward relative to the window sub to allow the lugs to move radially inward so as to disengage the locking lug from the disconnect housing, thereby freeing the disconnect housing to axially move away from window sub.

The load transfer sleeve may be slidably disposed about the lower end of the window sub and contacts the leading face of the disconnect housing to engage the external shoulder of the window sub. Upon threaded makeup with the lower drill string, the load transfer sleeve may be compressed while pre-loading the window sub and disconnect housing to a preferred load as defined by the interference gap. Once pre-loaded, the load transfer sleeve may be abutted against the shoulder of the window sub, the RSC can be torqued to the preferred value thus energizing the preload of the disconnect joint.

FIGS. 1A-B and FIG. 2 illustrate an assembly of a first embodiment of the basic disclosed apparatus components in a downhole drill string between an upper section and a lower section. An expanded description of each of these constituent components follows hereafter.

The disconnect housing 104 has a first outer surface and first inner surface defining a central bore therethrough. Upper and lower sockets 202, 202' with a generally hexagonal shape form radially on the first inner surface of the disconnect housing 104. Moreover, radial grooves 204 are formed thereon between the sockets 202, 202' having a polygonal cross-section.

Referring to FIG. 1B and FIG. 2, a disconnect assembly 102 may include a disconnect housing 104, a window sub 106, a locking lug 110, a prop sleeve 108, and a load transfer sleeve 112. A portion of the window sub 106 may be disposed concentrically in the The window sub 106 has a second outer surface and a second inner surface. The second outer surface has upper and lower torque transfer profiles 206, 206' that respectively mate with the upper and lower sockets 202, 202' when the locking assembly fully inserts into the disconnect housing 104 in the running position.

However, persons of ordinary skill in the art will understand that the principles described herein with respect to drill collars are applicable to any form or application of pipe or tube.

Returning to FIG. 2, the lower end of the disconnect housing 104 has a central bore capable of slidably receiving a portion of a locking assembly. The locking assembly comprises a window sub 106, a locking lug 110, a prop sleeve 108, and a load transfer sleeve 112. Description of the locking assembly components follows.

Referring to FIG. 2 the window sub 106 has a second outer surface and a second inner surface. The second outer surface has upper and lower torque transfer profiles 206*a*, 206*b* that respectively mate with the upper and lower sockets 202*a*, 202*b* when the locking assembly fully inserts into the disconnect housing 104 in the running position.

Referring to FIG. 2 and FIG. 3, a plurality of windows 208 may be defined and spaced radially in the body of the window sub 106 between the upper and lower torque transfer profiles 202*a*, 202*b*. Each window 208 may be generally elongated with substantially fully radiused opposite ends and substantially aligns with the radial grooves 204 on the disconnect housing 104.

A locking lug 110 may be disposed in each window 208. Lug projections 302 are formed on the outside edge of the lug 110 which extends radially outwardly from the corresponding window 208. Small feet 304*a*, 304*b* extend upwardly and downwardly from the inside of each lug 110 and are adapted to fit in a corresponding undercut 518*a*, 518*b* of the window 208 in the window sub 106. Thus, the locking lugs 210 cannot escape radially outwardly from windows 208, and the maximum radially outward position of each locking lug 110.

As pictured in the cross-cut view of FIGS. 4B-C, each socket 202 includes six (6) corresponding recesses 402 equally spaced circumferentially in an inner sidewall of the socket 202. The recesses 402 are equally spaced from one another at about sixty (60) degree intervals circumferentially around the socket 202 so as to receive the corners of a hexagonally shaped torque transfer profile of the window sub 106 (illustrated in FIG. 4B). The recesses 402 are dimensioned to provide for about three (3) degrees of rotation off center of the socket 202 with respect to the corners 406 of the window sub 106 in either direction when the corners 406 of the load transfer profile 202 are substantially centrally aligned in the recesses 402.

Each socket 202 also includes six (6) longitudinal sidewalls 206 that extend between and are respectively interconnected by the recesses 402. Referring to FIG. 4C, each of the sidewall 206 may include a first portion 410*a*' disposed adjacent to a second portion 410*a*" that is angularly displaced with respect to a recess 402*b*. The second portion 410*a*" extends from the recess 402*b* and intersects the first portion 410*a*' at an angle. As illustrated in FIG. 4C, the second portion 410*a*" may be disposed at an angle (α1) with respect to the first portion 410*a*'. In other versions, the angle (α1) may be about 2-5 degrees, and preferably about 3 degrees. The second portion may also have a length (L1) equal to about 20-30 percent of a length of the first portion, and preferably about 26 percent. The geometry of the socket 202 may provide for a contact point between the sidewalls 202, substantially at an intersection of a second portion 410*a*" with the first portion 410*a*', and a flank 206*a* of the torque transfer profile that is away from the corner 406*b* of the torque transfer profile. As illustrated in FIG. 4C, it is to be understood that each end of sidewall 202 intersection around the hexagonal shape may be generally the same and mirrored as described above.

An increase in the distance of the contact point away from the corner 406 of the window sub 106 increases the surface area and shifts the load from the corner 406 and distributes the stress concentration further away from the corner 406. This may provide for more surface area of the sidewall 202 to contact the torque transfer profile of the window sub 106, thereby improving the strength and operable life of the socket 202. This also reduces the risk of the window sub 106 becoming frictionally locked or stuck in the socket 202 and reduces the risk of the window sub 106 being stripped or the socket 202 slipping on the torque transfer profile.

As illustrated in FIGS. 4B-C, the contact point may be a distance (D1) away from the corner 406*b*. In some versions, the distance (D1) may be about 30 to 60 percent of half a length of the flank 206*a* (half of the length between corners 406*a*, 406*b*) of the torque transfer profile, and preferably, the distance (D1) is about 45 percent of half the length of the sidewall 202*a*. It is to be understood that each end of flank 206*a* intersection around the hexagonal shape may be generally the same and mirrored as described above.

In other versions, the sockets 202, 202' may be formed to have different cross-sectional shapes adapted to mate with different shaped torque transfer profile, for example, pentagonal, heptagonal, octagonal, double hexagonal, or other polygonal shapes of the type. The sidewalls 202 and recesses 402 may be equally spaced circumferentially.

FIG. 4D illustrates a downhole disconnect assembly 102 where each polygonal cross-section of the socket 202 and the torque transfer profile have truncated corners 402 instead of the recessed corners 402 shown in FIGS. 4B-C. The length of each truncated corner 402 may be shorter than the length of the sidewall 202. Furthermore, the edges (e.g., sidewalls and truncated corners) of the torque transfer profile may be slightly shorter than the corresponding edges of the socket 202.

The top plan view of FIGS. 4D-E show downhole disconnect assembly 102 that may improve the strength and operable life of the socket 202. As shown in FIG. 4D, each torque transfer profile includes six (6) longitudinal flanks 206*a-f* that extend between and are respectively interconnected by truncated corners 402*a-f*. Also, each socket 202 includes six (6) corresponding corners 406*a-f* equally spaced circumferentially in an inner sidewall of the socket 202.

Referring to FIG. 4E, each of the flanks 206*a-f* may include a first substantially straight portion 408*a*' disposed adjacent to second straight portion 408*a*" that is angularly displaced with respect to the first portion 408*a*'. The second portion 408*a*" extends from a truncated corner 404*a* and intersects the first portion 408*a*' at an angle. As illustrated in FIG. 4E, the second portion 408*a*" may be disposed at an angle (α1) with respect to the first portion 408*a*'. In some versions, the angle (α1) may be about 2-5 degrees, and preferably about 3 degrees. The second portion 408*a*" may also have a length (L1) equal to about 20-30 percent of a combined length of the first portion 408*a*' and second portion 408", and preferably about 26 percent. The geometry of the torque transfer profile provides for a contact point between the flank 206*a*, substantially at an intersection of a second portion 408*a*" with the first portion 408*a*', and a sidewall 202*a* of the socket 202 that may be away from the corner 402*a* of the socket 202.

In some versions, the torque transfer profile may be formed to have different cross-sectional shapes adapted to mate with different shaped sockets 202, for example, pentagonal, heptagonal, octagonal, double hexagonal, or other polygonal shapes of the type. The flanks 206*a-f* and truncated corners 404*a-f* may be equally spaced circumferentially.

As illustrated in FIG. 5A, upwardly facing lug shoulders, between the feet 214*a*, 214*b*, formed on the inside edge of the locking lug 110 define a retaining projection 506*b*.

Further, each lug 110 has curved ends 310 (illustrated in FIG. 3) adapted to generally conform to the curved ends 308 in the window 208. Thus, a person skilled in the art may recognize that stress concentrations are greatly reduced between lugs 210 and windows 208 as compared to lugs with substantially square ends.

The prop sleeve 108 may be adapted for close sliding engagement with the second inner surface of the window sub 106. Downwardly facing prop shoulders formed on the outside edge of the prop sleeve 108 define bosses 504*a-d*. In the running position, the prop sleeve 108 may be positioned within the inner bore of the window sub 106 such that the boss 504*b* aligns with upper foot 214*a*, boss 504*c* aligns with retaining projection 210 of the locking lug 110, and boss 504D aligns with lower foot 214*b*. The outside surfaces of the bosses 504*b*, 504*d* abut the inside surface of the feet 214*a*, 214*b* and retaining projection 506*b* so the lug projections 302 may remain engaged with the radial grooves 204 on the disconnect housing 104, thereby preventing axial movement of the window sub 106 relative to the disconnect housing 104.

One or more shear pins 502 may be attached to window sub 106 and extends radially into a slot defined in the prop sleeve 108. Thus, the prop sleeve 108 may be shearably held in the running configuration.

A threaded joint that may be used in drill string connections that meets industry standards is best exemplified as a rotary shouldered connection (RSC). FIG. 5A depicts a cross-sectional view of an assembly having an RSC joint 114*b* in a "hand-tight" position, comprising a male threaded pin 210 on the bottom end of the window sub 106 and a female threaded box 212 of the lower section. The RSC box 212 is shown threaded onto the RSC pin threads 210. When the disclosed apparatus may be assembled in a "hand-tight" position, a physical gap 516 may be present between the inner shoulder 514 of the load transfer sleeve 112 and the external shoulder 512 of the window sub 106.

Referring to FIG. 5B, the gap 516 may be eliminated by a tensile pre-load imposed upon the locking lug 110, window sub 106, and disconnect housing 104 sufficient to maintain shoulder contact upon final thread makeup of the RSC joint 114*b* to the recommended torque. To maintain integrity of the drill string, the threaded joints that make up the drill pipe and drill collars and tools may have to meet loading criteria. The joint may provide a leakproof seal and maintain face-to-face contact during the rigors of drilling. Also, the shoulders of the joint may maintain contact under tension and during the cyclic bending that occurs when passing through a dogleg bend in the trajectory of the wellbore.

FIG. 5B illustrates the disconnect apparatus 102 at an intermediate thread makeup of the RSC joint 114*b*. When the RSC threads are in intermediate engagement, the lower end of the disconnect housing 104 and upper end of the load transfer sleeve 112 are in juxtaposition to axially compress the load transfer sleeve 112 and remove the gap 516.

FIG. 5B illustrates the progression of the RSC to a final makeup at the recommended torque (torque greater than was necessary to shoulder the load transfer sleeve 112 to the window sub 106 in FIG. 5A), which also pre-loads the RSC such that high tensile and bending loads that occur during drilling minimizes separation of the joint shoulders. Furthermore, compression of the load transfer sleeve 112 applies a tensile pre-load to drive the radial grooves 204 on the disconnect housing 104 into the locking lug projections 302 and the locking lug 110 into contact with the curved upper end of the window 208 in the window sub 106.

FIGS. 6A-F illustrate operation of the disclosed apparatus if a drill string becomes stuck, or if it is desired to disconnect the drill string. The disconnect apparatus 102 may be actuated to release the upper portion of the drill string. A plug 220 may be launched down the drill string so that the plug may engage a chamfered internal seat 218 (illustrated in FIG. 6B) in the lower end of the prop sleeve 108. Hydraulic pressure may be applied in the drill string so that the plug 220 and prop sleeve 108 are forced downwardly within window sub 106, shearing shear pins 502. Movement of the prop sleeve 108 causes the bosses 504*b-d* to misalign with, and ultimately clear, the feet 214*a*, 214*b* and retaining projection 506*b* on the locking lug 110. Continued downward movement of the prop sleeve 108 releases the locking lug 110 to move away from the radial grooves 204 on the disconnect housing and inwardly onto the grooves 522*a*, 522*b* of the locking lug 110. Furthermore, inward movement of the locking lug 110 may be assisted by the tensile pre-load applied to the disconnect housing 104 and distributed to the radial grooves 204.

The prop sleeve 108 stops moving once the downwardly facing prop shoulders 504*b*, 504*c* abuts the upwardly facing lug shoulders 506*b*, 506*c*. At this point, an operator may pull on the drill string to disconnect the disconnect housing 104 from the window sub 106 to retrieve the upper drill string portion.

The remaining components may be later retrieved by conventional fishing tools.

What is claimed is:

1. A downhole tubular disconnect assembly, comprising:
- a housing having:
  - a first inner surface and a first outer surface;
  - an upper socket and a lower socket on the first inner surface; and
  - a plurality of radial grooves formed on the first inner surface between the sockets;
- a window sub having:
  - a second inner surface and a second outer surface;
  - an upper torque transfer profile and a lower torque transfer profile disposed about the second outer surface for respective slidable mating with the upper and lower sockets on the housing, thereby preventing relative rotation between the window sub and the housing; and
  - a window defined between the torque transfer profiles therein;
- a locking lug disposed in the window sub for locking the window sub to the housing and the sockets, thereby preventing relative longitudinal movement between the window sub and the housing;
- a prop sleeve for disengaging the locking lug, thereby allowing for longitudinal movement of the housing relative to the window sub; and
- a load transfer sleeve for transferring a tensile pre-load to the housing and window sub.

2. The tubular disconnect assembly of claim 1, wherein the load transfer sleeve is abutted against the housing.

3. The tubular disconnect assembly of claim 1, wherein the load transfer sleeve has a lip pushing the housing.

4. The tubular disconnect assembly of claim 1, wherein the load transfer sleeve is pushing the sub.

5. The tubular disconnect assembly of claim 1, wherein the load transfer sleeve is abutted against the sub.

6. The tubular disconnect assembly of claim 1, wherein a portion of the sub extends through the load transfer sleeve.

7. The tubular disconnect assembly of claim 1, wherein the load transfer sleeve is disposed around the sub.

8. The tubular disconnect assembly of claim 1, wherein the load transfer sleeve axially pushes the housing.

9. The tubular disconnect assembly of claim 1, wherein the housing axially pushes the locking lug.

10. A tubular disconnect assembly for disconnecting a downhole tubular, comprising:
- a housing comprising:
  - a first set of socket surfaces;
  - a second set of socket surfaces; and
  - a groove disposed between the first set of socket surfaces and the second set of socket surfaces of the housing;
- a sub disposed in the housing, the sub comprising:
  - a first set of socket surfaces;
  - a second set of socket surfaces; and
- a window disposed between the first set of socket surfaces and the second set of socket surfaces of the sub; and
- a locking lug extended through the window into the groove.

11. The tubular disconnect assembly of claim 10, wherein the window is adjacent the groove.

12. The tubular disconnect assembly of claim 10, wherein a surface of the first set of socket surfaces of the housing is capable of being abutted against a surface of the first set of socket surfaces of the sub.

13. The tubular disconnect assembly of claim 10, wherein a surface of the second set of socket surfaces of the housing is capable of being abutted against a surface of the second set of socket surfaces of the sub.

14. The tubular disconnect assembly of claim 10, wherein the housing further comprises a socket surface having two surface portions forming an angle less than 180 degrees.

15. The tubular disconnect assembly of claim 10, wherein the sub further comprises a socket surface having two surface portions forming an angle less than 180 degrees.

16. The tubular disconnect assembly of claim 10, wherein the housing further comprises a radiused connecting surface.

17. The tubular disconnect assembly of claim 10, wherein the housing further comprises one or more connecting surfaces, wherein none of the connecting surfaces is in physical contact with the sub.

* * * * *